US005501273A

United States Patent [19]

Puri

[11] Patent Number: 5,501,273

[45] Date of Patent: Mar. 26, 1996

[54] METHOD FOR DETERMINING THE RESERVOIR PROPERTIES OF A SOLID CARBONACEOUS SUBTERRANEAN FORMATION

[75] Inventor: Rajen Puri, Aurora, Colo.

[73] Assignee: Amoco Corporation, Chicago, Ill.

[21] Appl. No.: 317,742

[22] Filed: Oct. 4, 1994

[51] Int. Cl.[6] ..... E21B 43/16; E21B 43/30; E21B 47/06

[52] U.S. Cl. ..... 166/252.5; 73/155; 166/245; 436/27

[58] Field of Search ..... 166/250, 252, 166/245; 73/155; 436/27, 28, 29

[56] References Cited

U.S. PATENT DOCUMENTS

| | | | |
|---|---|---|---|
| 3,993,131 | 11/1976 | Riedel | 166/252 |
| 4,423,625 | 1/1984 | Bostic, III et al. | 166/250 |
| 4,597,290 | 7/1986 | Bourdet et al. | 166/250 X |
| 4,862,962 | 9/1989 | Prouvost et al. | 166/250 |
| 5,085,274 | 2/1992 | Puri et al. | 166/252 |
| 5,337,821 | 8/1994 | Peterson | 166/250 |

*Primary Examiner*—George A. Suchfield
*Attorney, Agent, or Firm*—Charles P. Wakefield; Scott P. McDonald; Robert E. Sloat

[57] ABSTRACT

A method for determining the reservoir properties of a solid carbonaceous subterranean formation is disclosed. The method uses field data obtained from an injection/flow-back test, which utilizes a gaseous desorbing fluid, in conjunction with reservoir modeling techniques to determine the reservoir quality and the enhanced methane recovery characteristics of the formation.

34 Claims, 10 Drawing Sheets

METHOD FOR DETERMINING THE RESERVOIR PROPERTIES OF A SOLID CARBONACEOUS SUBTERRANEAN FORMATION

FIELD OF THE INVENTION

The invention generally relates to methods for recovering methane from solid carbonaceous subterranean formations, such as coal seams. The invention more particularly relates to methods for determining the reservoir quality of a solid carbonaceous subterranean formation. The invention also relates to methods for determining the enhanced methane recovery characteristics of a solid carbonaceous subterranean formation.

BACKGROUND OF THE INVENTION

Solid carbonaceous subterranean formations such as coal seams can contain significant quantities of natural gas. This natural gas is composed primarily of methane, typically between 90 and 95% by volume. The majority of the methane is adsorbed to the carbonaceous material of the formation. In addition to the methane, lesser amounts of other compounds such as water, nitrogen, carbon dioxide, and heavier hydrocarbons can be held within the carbonaceous matrix or adhered to its surface. The world-wide reserves of methane found within solid carbonaceous subterranean formations are huge, and therefore techniques have been developed to facilitate the recovery of methane from such formations.

Historically, the methane has been primarily recovered from solid carbonaceous subterranean formations by depleting the reservoir pressure. With pressure depletion methods, as the reservoir pressure of the solid carbonaceous subterranean formation is lowered, the partial pressure of methane within the cleats decreases. This causes methane to desorb from the methane sorption sites and diffuse to the cleats. Once within the cleat system, the methane flows to a recovery well where it is recovered. The reservoir pressure of the formation continually decreases as methane is recovered from the solid carbonaceous subterranean formation. Typically, the methane recovery rate decreases over time as the reservoir pressure of the formation decreases. For coal seams, it is believed that primary pressure depletion techniques are capable of economically producing about 35 to 70% of the original methane-in-place within a seam. The recovery rate of methane from such formations and the percentage of the original methane-in-place that can be recovered from a formation by using primary pressure depletion techniques is dependent on the reservoir properties of the formation.

Predicting the amount of methane contained in a solid carbonaceous subterranean formation, the expected methane recovery rate, and the percentage of methane which can be expected to be recovered from a formation is difficult, time consuming, and expensive. Typically, core samples are obtained from the formation of interest to determine the reservoir properties of the formation, including the amount of methane contained within the formation, and to determine the thickness and vertical placement of the carbonaceous material. Unfortunately, solid carbonaceous subterranean formations such as coal seams are often very heterogeneous and may exhibit a great deal of anisotropy in both the vertical and horizontal directions. Also, the carbonaceous material is often found in discrete bedding layers, which are often separated by shale or sandstone. Therefore, core samples often do not provide reliable estimates of the reservoir quality.

Full scale production pilots often are required to better delineate the methane recovery potential for a particular solid carbonaceous subterranean formation. A typical production pilot has several recovery wells which penetrate the solid carbonaceous subterranean formation. A production pilot which is used to delineate the recovery of methane from a solid carbonaceous subterranean formation by primary pressure depletion techniques can cost several million dollars and require several months or years to delineate the methane recovery potential from a particular solid carbonaceous subterranean formation.

Pressure fall-off tests have been used in the past to determine the wellbore skin, the reservoir permeability, and the reservoir pressure of the region of a coal seam surrounding a wellbore. In these types of tests, water is typically injected into the formation through an injection well. The injection is continued for the desired period of time and then the injection well is shut-in. During the period of time when the injection well is shut-in, the pressure in the wellbore is measured. The pressure fall-off data can be analyzed to provide the skin, permeability, and reservoir pressure. However, as discussed earlier, solid carbonaceous subterranean formations often exhibit a high degree of heterogeneity and anisotropy, which can not be determined from standard pressure fall-off tests. Therefore, standard pressure fall-off tests typically do not provide enough information to sufficiently describe the reservoir quality of a typical solid carbonaceous subterranean formation.

The recovery of methane using primary pressure depletion techniques may not be satisfactory for many solid carbonaceous subterranean formations. In order to improve the recovery of methane from solid carbonaceous subterranean formations, techniques have been developed which enable a larger percentage of the original methane-in-place to be recovered from such a formation and at a higher rate than could be attainable using pressure depletion techniques. One such technique utilizes an injected gaseous desorbing fluid, such as nitrogen, oxygen-depleted air, air, flue gas, or any other gas which contains at least 50% by volume nitrogen. The injected gaseous desorbing fluid reduces the partial pressure of methane in the cleats and causes methane to desorb from methane sorption sites into the cleats. Another such technique utilizes an injected gaseous desorbing fluid which contains at least 50% by volume carbon dioxide. The carbon dioxide contained in the fluid preferentially adsorbs to the methane sorption sites and thereby causes the methane to desorb from the sorption sites and diffuse into the cleats.

Once within the cleats, the methane moves toward a recovery well. Additional advantages occur from both the above techniques because the injected gaseous desorbing fluid tends to pressure up the formation, thereby allowing faster recovery of methane-in-place from a solid carbonaceous subterranean formation than with primary pressure depletion techniques. Also, the use of injected gaseous desorbing fluid allows a greater percentage of methane-in-place to be recovered than with primary pressure depletion techniques. The methods which utilize an injected gaseous desorbing fluid to enhance the recovery of methane from a solid carbonaceous subterranean formation are sometimes hereinafter referred to as "enhanced methane recovery techniques."

While the use of enhanced methane recovery techniques improve the recovery of methane from a formation, these techniques also require extensive design work and engineering. Further, the higher recovery rate and the additional methane-in-place which can be recovered using enhanced methane recovery techniques may not justify the additional cost associated with implementing the techniques on a particular formation.

In order to determine whether enhanced recovery techniques are appropriate for a particular solid carbonaceous subterranean formation, the recovery of methane from the formation using such techniques must be accurately predicted. Unfortunately, the reservoir characteristics determined from a typical pressure fall-off test alone will not provide enough information to accurately predict the recovery of methane which can be expected from a production project which utilizes enhanced methane recovery techniques. And, as with primary pressure depletion techniques, a full scale production pilot which utilizes enhanced methane recovery techniques can cost several million dollars and require months or years to complete.

What is desired is a method which can determine the reservoir quality of a solid carbonaceous subterranean formation. Additionally, what is desired is a relatively quick and inexpensive method which is capable of predicting the methane recovery rate and the percentage of the original methane-in-place which can be recovered from a solid carbonaceous subterranean formation using enhanced methane recovery techniques.

As used herein, the following terms shall have the following meanings:

(a) "air" refers to any gaseous mixture containing at least 15 volume percent oxygen and at least 60 volume percent nitrogen. "Air" is typically the atmospheric mixture of gases found at the well site and contains between about 20 and 22 volume percent oxygen and between about 78 and 80 volume percent nitrogen;

(b) "carbonaceous material" refers to the solid carbonaceous materials that are believed to be produced by the thermal and biogenic degradation of organic matter. The term carbonaceous material specifically excludes carbonates and other minerals which are believed to be produced by other types of processes;

(c) "characteristic residence flow time" is the time required for a molecule of a gaseous non-adsorbing fluid, such as helium, to travel through the cleat system of a solid carbonaceous subterranean formation from a point in the formation near an injection wellbore to a point in the formation near a recovery wellbore;

(d) "characteristic diffusion time" for a solid carbonaceous subterranean formation is the time required for 67% of a gaseous fluid to desorb or adsorb to the formation's carbonaceous matrix.

(e) "cleats" or "cleat system" is the natural system of fractures within a solid carbonaceous subterranean formation;

(f) a "coalbed" comprises one or more coal seams in fluid communication with each other;

(g) "coal seams" are carbonaceous formations which typically contain between 50 and 100 percent organic material by weight;

(h) the "effective permeability" is a measure of the resistance offered by a formation to the movement of gaseous fluids through it. Effective permeability will vary with different pore pressures and can vary by location within the formation. Effective permeability includes stress dependent permeability effects and relative permeability effects;

(i) the "effective permeability relationship" is a description of how the effective permeability varies with pore pressure and how it varies with the water saturation within the formation. This relationship is important since the pore pressure and the water saturation can change as gaseous desorbing fluid is injected into the formation;

(j) "flue gas" refers to the gaseous mixture which results from the combustion of a hydrocarbon with air. The exact chemical composition of flue gas depends on many variables, including but not limited to, the combusted hydrocarbon, the combustion process oxygen-to-fuel ratio, and the combustion temperature;

(k) "formation parting pressure" and "parting pressure" mean the pressure needed to open a formation and propagate an induced fracture through the formation;

(l) "fracture half-length" is the distance, measured along the fracture, from the wellbore to the fracture tip;

(m) "gaseous desorbing fluid" includes any fluid or mixture of fluids which is capable of causing methane to desorb from a solid carbonaceous subterranean formation;

(n) the "initial reservoir pressure" is the reservoir pressure which existed within the wellbore at the time of the original completion of the wellbore into the solid carbonaceous subterranean formation;

(o) "$K_i$" is the effective permeability which existed within the formation at the initial reservoir pressure;

(p) "$K_f$" is the effective permeability which exists within the formation for a given pore pressure;

(q) "pore pressure" is the pressure present within the pore spaces of the cleat system. The pore pressure can vary throughout the formation and can vary as fluids are injected into and withdrawn from the formation;

(r) "reservoir flow capacity" is a measure of the flow rate that can be achieved within a solid carbonaceous subterranean formation. The reservoir flow capacity is the product of the effective permeability times the height or thickness of the formation. For an injection wellbore, the reservoir flow capacity should take into account the stress dependent permeability relationship of the formation, since the effective permeability present within the near wellbore region will vary as the pore pressure within the near wellbore region changes during injection of gaseous desorbing fluid;

(s) "reservoir pressure" means the pressure at the face of the productive formation when the well is shut-in. The reservoir pressure can vary throughout the formation. Also, the reservoir pressure may change over time as fluids are produced from the formation and/or gaseous desorbing fluid is injected into the formation;

(t) "solid carbonaceous subterranean formation" refers to any substantially solid carbonaceous, methane-containing material located below the surface of the earth. It is believed that these methane containing materials are produced by the thermal and biogenic degradation of organic matter. Solid carbonaceous subterranean formations include but are not limited to coalbeds and other carbonaceous formations such as antrium, carbonaceous, and devonian shales;

(u) "sorption" refers to a process by which a gas is held by a carbonaceous material, such as coal, which contains micropores. The gas typically is held on the coal in a condensed or liquid-like phase within the micropores, or the gas may be chemically bound to the coal;

(v) "sweep" refers to the region of a formation contacted by a fluid introduced into the formation. The sweep of the formation is measured as a percentage of the formation contacted; The total sweep is the product of the sweep in the areal and vertical directions;

(w) "well spacing" or "spacing" is the straight-line distance between the Individual wellbores of two separate wells. The distance is measured from where the wellbores intercept the formation of interest;

(x) "wellbore skin" is a measure of the relative damage to the region of the formation surrounding the wellbore.

SUMMARY OF THE INVENTION

It has been surprisingly discovered that a simple injection and flow-back test can be utilized in conjunction with reservoir modeling techniques, such as numerical reservoir simulation, to determine the reservoir quality and the enhanced methane recovery characteristics of a solid carbonaceous subterranean formation. In the invention, a gaseous desorbing fluid which preferably contains at least 50% by volume nitrogen is injected into the formation through a wellbore at a known injection rate. After the desired quantity of fluid has been injected, the wellbore is preferably shut-in and a pressure response within the wellbore is measured. Thereafter, at least a portion of the injected fluid is allowed to flow-back through the wellbore to the surface. The chemical composition of the fluid which flows-back through the wellbore is monitored over time. One or more of the following field data collected during the test can be used in conjunction with reservoir modeling techniques to determine the reservoir quality of the formation and to determine the enhanced methane recovery characteristics of the formation: the injection rate of the gaseous desorbing fluid, the chemical composition of the fluid which flows-back through the wellbore, the wellbore pressure response during the shut-in, the wellbore pressure response during injection and flow-back, the volumetric rate at which fluid flows back through the wellbore, the chemical composition of the injected fluid, and the volumetric amount of any fluid which may have been previously produced from the formation through the wellbore.

Preferably, the reservoir quality and the enhanced methane recovery characteristics are determined by history matching a numerical reservoir simulator, which models the formation, with the data measured during the injection period, the flow-back period, and any prior production period. The enhanced methane recovery characteristics of the formation can be used to develop an "enhanced methane recovery reservoir description" for the solid carbonaceous subterranean formation. The enhanced methane recovery characteristics and the reservoir description will assist in obtaining any required governmental approval for a project and will facilitate the implementation of production projects which utilize enhanced methane recovery techniques.

One object of the invention is to provide a method for determining the reservoir quality of a solid carbonaceous subterranean formation.

Another object of the invention is to provide a method for forecasting well performance characteristics and the economic feasibility of recovering methane from solid carbonaceous subterranean formations using primary depletion or enhanced methane recovery techniques.

A more specific object of the invention is to determine at least some of the enhanced methane recovery characteristics of such a formation.

Another more specific object of the invention is to develop an enhanced methane recovery reservoir description which can be utilized to predict the enhanced methane recovery rate from a formation.

Another more specific object of the invention is to use the enhanced methane recovery reservoir description to predict the percentage of the original methane-in-place which can economically be recovered from such a formation using enhanced methane recovery techniques.

A further object of the invention is to determine a production project's operating conditions, such as: the pressure to use to inject gaseous desorbing fluid into a solid carbonaceous subterranean formation; the rate at which gaseous desorbing fluid can be injected into a formation for a given injection pressure; the spacing to utilize between injection and recovery wells; the placement of wells; and the preferred chemical composition of the injected fluid to be utilized.

Numerous additional advantages and features of the present invention will become readily apparent from the following detailed description of the invention, the FIGS., the embodiments described therein, and the claims.

DESCRIPTION OF THE EMBODIMENTS

Figure 1:
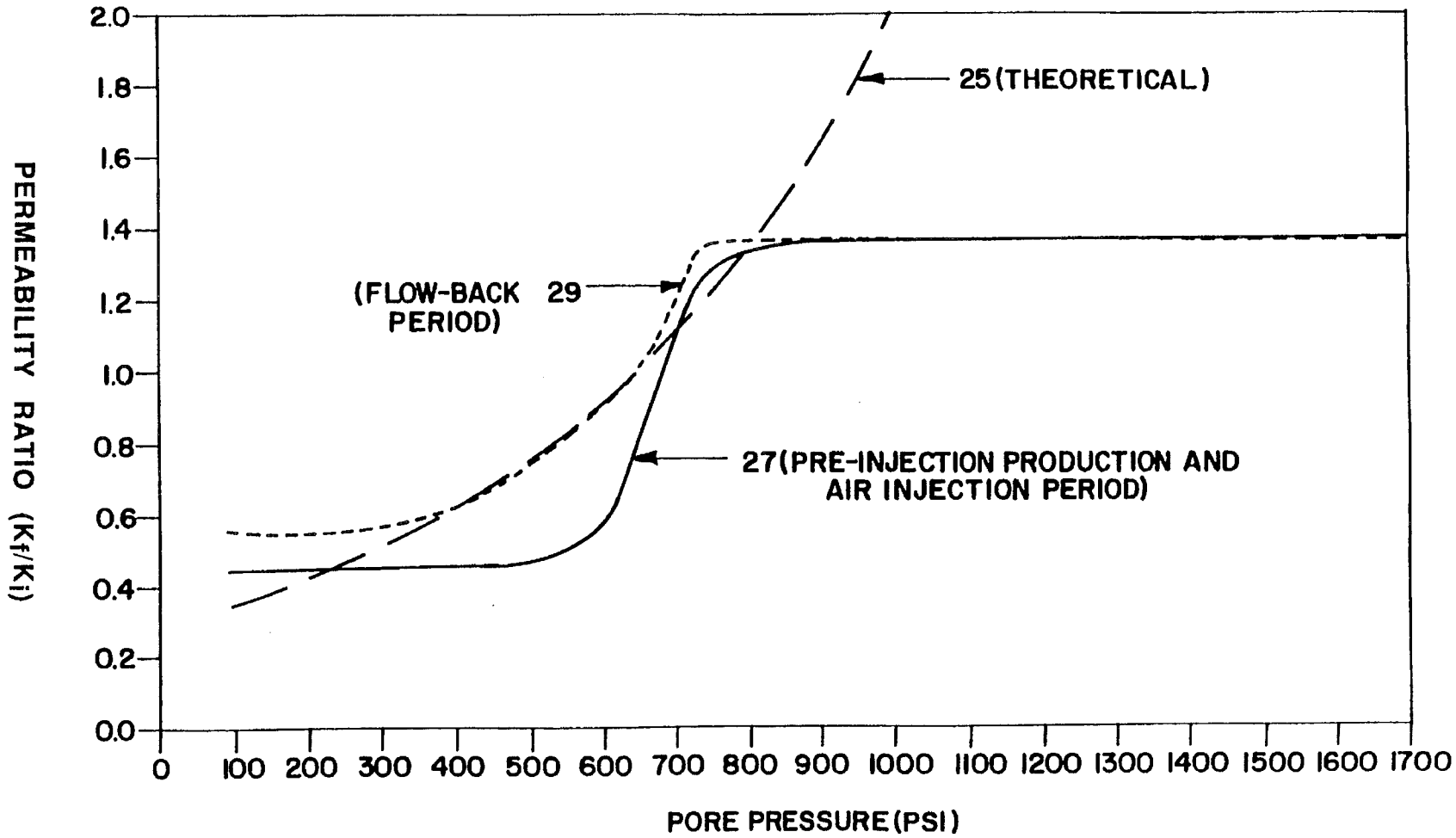
FIG. 1 is a graph of the permeability ratio ($K_f/K_i$) versus pore pressure for a coal seam investigated by the invention. The graph shows the stress dependent permeability relationship which is exhibited by the coal.

While simulators have been able to accommodate the input of reservoir properties such as permeability, porosity, and diffusion time, it was not appreciated in the art that the field data from an injection/flow-back test could be utilized in conjunction with reservoir modeling techniques to determine the reservoir quality and the enhanced methane recovery characteristics of a solid carbonaceous subterranean formation. Additionally, no one realized that a numerical reservoir simulator could be history matched with the field data obtained from an injection/flow-back test to provide a quick, inexpensive, and accurate method for determining the reservoir quality and the enhanced methane recovery characteristics of the formation and for developing an accurate reservoir description for the formation.

As discussed above, the invention provides an improved method for determining the reservoir properties of a solid carbonaceous subterranean formation. It provides a relatively quick and inexpensive method for determining and/or verifying such reservoir properties as porosity, effective permeability, reservoir pressure, the bulk density of the formation, the maximum sorption capacity of the formation for methane, the maximum sorption capacity of the formation for nitrogen and/or other gases which may sorb to the carbonaceous material of the formation, reservoir continuity, reservoir heterogeneity and any reservoir anisotropy, the formation parting pressure, and adsorbed methane content of the formation in standard cubic feet per ton. These reservoir properties are hereinafter sometimes referred to as the "reservoir quality" of a solid carbonaceous subterranean formation.

The invention also provides a method for determining the "enhanced methane recovery characteristics" of a solid carbonaceous subterranean formation. In addition to those reservoir properties which describe the reservoir quality, the enhanced methane recovery characteristics include, but are not limited to: the injectivity of gaseous desorbing fluid, reservoir flow capacity, the stress dependent permeability relationship with varying pore pressures, the multi-component characteristic diffusion time for a gaseous desorbing fluid or characteristic diffusional time constants for individual gases such as methane or nitrogen, the characteristic residence flow time within the formation, the effective permeability relationship, the fracture half-length associated with an injection well or a recovery well, the relative permeability relationship, and other reservoir characteristics which affect the technical and/or economic feasibility of applying enhanced methane recovery techniques to a solid carbonaceous subterranean formation.

Further, the invention provides a method for determining whether a particular wellbore is in fluid communication with non-carbonaceous formations, such as sandstone, to which oxygen does not appreciably sorb. It should be noted that a wellbore may be in fluid communication with a sandstone formation even if the wellbore does not penetrate the sandstone. For example, the sandstone may be located a few feet away from the wellbore, but still be close enough so that a significant portion of the injected gaseous desorbing fluid can travel through the sandstone and thereby bypass the majority of the solid carbonaceous subterranean formation. Determining whether or not a wellbore is in fluid communication with formations such as sandstone can be particularly important, when deciding whether or not a wellbore should be utilized to inject gaseous desorbing fluid into the solid carbonaceous subterranean formation. If an injection wellbore is in fluid communication with sandstone, a large percentage of the injected gaseous desorbing fluid could bypass the solid carbonaceous subterranean formation and therefore be wasted.

As discussed earlier, enhanced methane recovery techniques can be technically complex to implement on a formation. And, the economic return on production projects which utilize such techniques can be sensitive to the enhanced methane recovery characteristics of a particular formation and the design of the enhanced methane recovery techniques utilized on that particular formation. In order to fully evaluate a solid carbonaceous subterranean formation to determine if enhanced methane recovery techniques should be utilized, as many as possible of the enhanced methane recovery characteristics of the formation should be determined.

One analysis method which can be used to determine the reservoir quality and/or the enhanced methane recovery characteristics of the formation is to history match, with a numerical reservoir simulator, the historical data obtained from the injection, flow back, and/or production periods. As a first step in the history match procedure, the estimated values for various reservoir parameters, such as the wellbore skin factor, reservoir pressure, and reservoir permeability are input into the reservoir simulator. The values for the wellbore skin factor, reservoir pressure, and reservoir permeability are preferably obtained from a pressure buildup or fall-off test performed on the wellbore. During the history match procedure, reservoir parameters, such as permeability, are systematically adjusted until a "history match" is obtained between the output of the reservoir simulator and the historical data. A detailed description of reservoir simulation, which includes suggestions on how to conduct a "history match", is contained in *Reservoir Simulation,* editors C. C. Mattar and R. L. Dalton, Henry, L. Doherty Series Monograph Volume 13, Society of Petroleum Engineers (Richardson, Tex., 1990l), which is hereby incorporated by reference.

The determination of the enhanced methane recovery characteristics of a formation will also assist in developing an enhanced methane recovery reservoir description for the formation. When history matching techniques are utilized, the enhanced methane recovery reservoir description contained in the numerical reservoir simulator is developed and updated concurrently with the determination of the reservoir quality and the enhanced methane recovery characteristics.

The updated numerical reservoir simulator can be used to design a production project which utilizes enhanced methane recovery techniques. In designing a production project, the well-spacing to utilize, the preferred wellbore placement pattern for any injection wells and any recovery wells, the pressure at which to inject the gaseous desorbing fluid, the preferred chemical composition of the injected gaseous desorbing fluid, and the wellbore pressures to operate a recovery well or wells should be determined together with the predicted injection rates of gaseous desorbing fluid, the predicted total fluid recovery rates, the predicted methane recovery rates, the predicted water production rate, the percentage of original methane-in-place which is predicted to be recoverable, the chemical compositions of the fluid produced from a recovery well over time with various production project design scenarios, and the surface facilities, such as injection, purification, and water handling facilities which will be required for various production project design scenarios. By accurately predicting a project's facility requirements, the enhanced methane recovery techniques can be efficiently implemented in a timely and cost efficient manner.

THE WELLBORE AND THE INJECTION OF THE GASEOUS DESORBING FLUID

Various types of wellbores may be used to inject gaseous desorbing fluid into the solid carbonaceous subterranean formation. The wellbore can be of any type, as long as it penetrates the formation and is capable of transporting the gaseous desorbing fluid under pressure to the formation. For example, the wellbore may be an exploratory wellbore, a corehole wellbore that was drilled to obtain core samples from the formation, or a production wellbore which may or may not previously have been utilized to produce methane from the formation by the use of primary pressure depletion techniques.

The region of the wellbore which penetrates the solid carbonaceous subterranean formation can be completed open-hole or it can be completed with casing which is perforated near the formation to allow fluid to flow between the formation and the wellbore. It is preferable to utilize a wellbore which is completed with casing and perforations if there are several carbonaceous seams that are vertically separated from one another. This will allow gaseous desorbing fluid to be injected into each seam independently. The injection of gaseous desorbing fluid independently into each seam will facilitate the determination of the the reservoir quality and enhanced methane recovery characteristics of the individual carbonaceous seams, The preferred gaseous desorbing fluids to utilize are fluids which contain nitrogen as the major constituent. Examples of such fluids are nitrogen, flue gas, air and oxygen-depleted air. The more preferred fluids to utilize are fluids which contain between 5 and 25 percent by volume oxygen, such as air and oxygen-depleted air. Use of a gaseous desorbing fluid which contains oxygen will facilitate the determination of any reservoir anisotropy and reservoir heterogeneity within the formation. The use of a gaseous desorbing fluid which contains oxygen will also facilitate the determination of whether a particular wellbore is in fluid communication with non-carbonaceous formations, such as sandstone, to which oxygen does not appreciably sorb.

Prior to commencing the injection of gaseous desorbing fluid, the wellbore preferably is shut-in. This will allow the pressure in the formation near the wellbore to approach stabilization. The length of time required to approach stabilization will depend on the reservoir properties of a particular formation and the condition of the wellbore. For a typical wellbore, a shut-in of approximately two to three weeks should be sufficient.

During injection of gaseous desorbing fluid, the wellbore pressure near the formation and the injection rate are preferably monitored. The wellbore pressure can be monitored by placing a downhole pressure transducer near the formation or alternatively, the surface injection pressure can be measured and adjusted to account for the height of the fluid column within the wellbore above the formation.

The injection of gaseous desorbing fluid is preferably carried out in steps, with each subsequent step utilizing a higher injection pressure than the previous step. Each step is preferably of a sufficient duration to allow the injection rate to approach an approximately constant value. When determining the duration to use for each step, it is preferable due to economic considerations to keep the duration of each injection step less than two weeks, more preferably less than one week.

It is believed that separating the injection into steps, each having its own injection pressure, will force a more accurate history match with the data obtained during the injection period. This in turn will provide a more accurate determination of the enhanced methane recovery characteristics of the formation. Additionally, by using more than one injection pressure, a more accurate plot of the injection rate versus injection pressure can be constructed. The plot of injection rate versus injection pressure together with the predicted methane recovery rates for a given injection rate and the injection pressure will assist in determining what is the optimum injection pressure to use. In general, the higher the injection pressure used, the greater the compression costs associated with injecting a cubic foot of gaseous desorbing fluid into the formation. Therefore, a plot of injection rate versus injection pressure can be used to determine the relative cost of injecting a cubic foot of gaseous desorbing fluid at various injection pressures and the expected maximum injection rate for each of the pressures. This is an important consideration because the cost of compressing the gaseous desorbing fluid is a significant portion of the overall costs associated with a production project which utilizes enhanced methane recovery techniques.

The injection rate increase obtained for a given increase in injection pressure is dependent at least-in-part on the stress dependent permeability relationship which is exhibited by the formation. The stress dependent permeability relationship describes the change in the effective permeability which occurs within the formation as the pore pressure of the formation changes. For injection pressures below the formation parting pressure, it is believed that the stress dependent permeability relationship will cause the permeability ratio ($K_f/K_i$) to increase as shown in FIG. 1. This in turn will tend to increase the effective permeability of the formation. The increase in the effective permeability of the formation as pore pressure increases allows greater volumes of gaseous desorbing fluid to be injected into the formation than would be expected based on the injection pressure utilized.

As can be seen from FIG. 1, eventually a point is reached where the permeability ratio increases very little for a given pore pressure increase. Therefore, eventually the incremental injection rate increase which is obtained for an incremental pressure change should start to decrease.

In general, for enhanced methane recovery techniques, the methane recovery rate is proportional to the injection rate of gaseous desorbing fluid. This is due to the fact that as the injection rate increases, a greater number of gaseous desorbing fluid molecules are available to cause methane to desorb into the cleats. Additionally, as the injection pressure increases, the pore pressure present within the formation will tend to increase both in the near injection wellbore region and eventually within the formation in general. This increase in pore pressure will cause the effective permeability of the formation to increase. This will allow more gaseous desorbing fluid to be injected into the formation and more methane per unit time to travel through the formation to a recovery well. Therefore, as the injection pressure increases, the higher injection rate and the higher effective permeability which results will cause a higher enhanced methane recovery rate.

However, it is believed that eventually a point is reached where the incremental increase in methane recovery rate which can be obtained for a given incremental injection pressure increase does not economically justify the additional compression costs associated with the incremental increase in injection pressure and injection rate required to obtain the incremental increase in methane recovery rate. Stepped rate injection of gaseous desorbing fluid will aid in obtaining a more accurate determination of the stress dependent permeability relationship versus pore pressure for the formation and will thereby assist in determining the optimum injection pressure to utilize on a particular production project.

The injection of gaseous desorbing fluid is ceased after the desired quantity of fluid has been introduced into the formation. In one aspect of the invention, it is preferable to inject a sufficient volume of gaseous desorbing fluid so that the length of the radius of investigation is at least 0.5% of the spacing between the wellbore where the gaseous desorbing fluid is being injected and the nearest offset wellbore, more preferably at least 1% of the spacing, and in some situations between 1 and 10% of the spacing. The radius of investigation is determined by calculating the theoretical size of the region which is probed by the injected gaseous desorbing fluid. In general, as the radius of investigation increases, the region of the formation which is probed by the injected gaseous desorbing fluid increases. As the region probed increases, the confidence that the reservoir properties determined will accurately describe the formation increases. However, the size of the radius of investigation is practically limited by the cost associated with increasing the radius of investigation. In order to double the radius of investigation, the quantity of gaseous desorbing fluid utilized would need to be quadrupled. Therefore, it can be seen that there is a practical economic limit to the size of the radius of investigation that can be utilized. When calculating the radius of investigation, it is assumed that the radius defines a cylindrical volume, centered about the longitudinal axis of the wellbore, which is uniformly probed by the gaseous desorbing fluid.

Equation 1 below can be used to calculate the radius of investigation.

$$r_1 = 0.029\sqrt{\frac{Kt}{\phi\mu C_t}} \quad (1)$$

K=effective permeability of the formation in milidarcy;

Ø=porosity of the formation;

μ=viscosity of the gaseous desorbing fluid in centipoise;

$C_t$=the total system compressibility in inverse pounds per square inch $(psi)^{-1}$; and t=the duration of the injection period in hours.

As can be seen from equation (1), the size of the radius of investigation depends on the effective permeability of the formation, the porosity of the region, the viscosity of the fluids present within the formation, the total compressibility of the formation, and the duration of the injection period. It should be noted that the viscosity used to calculate the radius of investigation is the viscosity of the injected gaseous desorbing fluid. Also, the stress dependent permeability relationship of the formation may cause the effective permeability near the wellbore to differ from the effective permeability of a region which is further from the wellbore. Therefore, the average effective permeability for the formation is used to calculate the radius of investigation. A more complete discussion of the radius of investigation and how to calculate it can be found in "Advances in Well Test Analysis," pg. 19, Robert C. Earlougher, Jr., second printing, Society of Petroleum Engineers Monograph No. 5, (1977), which is hereby incorporated by reference.

It should be noted that if the formation exhibits any heterogeneity and anisotropy, the region contacted by the gaseous desorbing fluid may not be uniformly distributed about the wellbore and therefore, the gaseous desorbing fluid may probe regions of the formation located a great distance beyond the radius of investigation.

In another aspect of the invention, them is not an offset wellbore present at the time of the injection of the gaseous desorbing fluid into the formation, but at least one more wellbore, on which the invention will be used, will be drilled in the future. In this aspect, it is preferable to inject a sufficient volume of gaseous desorbing fluid so that the length of the radius of investigation is at least 0.5% of the spacing between the wellbore where the gaseous desorbing fluid is being currently injected and the nearest region where a wellbore will be drilled to inject gaseous desorbing fluid into the formation, more preferably at least 1% of the spacing, and in some situations between 1 and 10% of the spacing.

In a third aspect of the invention, the ability of the gaseous desorbing fluid to probe regions of the formation a great distance beyond the radius of investigation is utilized. In this aspect of the invention, enough gaseous desorbing fluid is injected to cause a response in one or more nearby offset wells. The response may include a change in wellbore pressure, a change in the methane recovery-rate, and/or a change in the chemical composition of the fluids being produced from the offset wells. The response of at least one of the offset wells preferably is monitored. The data obtained during the monitoring of the offset well can be used to determine the reservoir quality and the enhanced methane recovery characteristics for the region of the formation between the injection well and the offset well.

For example, for a particular formation, the characteristic diffusion time and the characteristic residence flow time for the gaseous components of the injected gaseous desorbing fluid can be determined by measuring the chemical composition of the fluids produced over time from an offset well. When determining the characteristic residence flow time, it is preferable to add a non-adsorbing tracer gas, such as helium, to the injected gaseous desorbing fluid. The time it takes the helium to reach an offset well will provide the information necessary to determine the characteristic residence flow time for gases to travel between the injection well and the offset well.

A rough approximation of the characteristic diffusion time for a gaseous component of the gaseous desorbing fluid can be determined by comparing the time it takes for the gaseous component to reach the offset well, relative to the time it took the non-adsorbing tracer gas to reach the same well. A more accurate determination of the characteristic diffusion time can be attained by inputting the rough approximation obtained for the characteristic diffusion time into a numerical reservoir simulator, the characteristic diffusion time is then adjusted until a history match is obtained between the predicted and the historical chemical composition data and/or the fluid recovery rates measured at an offset well. Alternately, a characteristic diffusion time obtained from core sample diffusion experiments or a characteristic diffusion time obtained from the literature can be input into the numerical reservoir simulator which is then history matched by adjusting the characteristic diffusion time until a match is obtained between the predicted data and the historical chemical composition data and recovery rate data measured at the offset well.

If the desorbing fluid injected into the formation contains oxygen, then by measuring the relative concentration of gaseous oxygen over time in the fluids recovered from the offset well, it is possible to determine the percentage of carbonaceous material which is contained in subsurface regions through which injected gaseous desorbing fluid travelled. As described below, carbonaceous materials, such as coal, readily sorb gaseous oxygen, whereas non-carbonaceous materials do not.

The quantity of oxygen which can be sorbed by a particular region of a formation depends on the percentage of carbonaceous material which makes up the formation. The relative percentage of carbonaceous material which is contained in the formation can be calculated from the bulk density. In order to determine the sorption capacity of the formation for oxygen, the sorption capacity of mineral matter free carbonaceous material is determined empirically or is obtained from literature sources. An estimated value for the bulk density of the formation in the region between the injection wellbore and an offset wellbore is then used to predict the sorption capacity of the formation. This predicted value for the sorption capacity together with information regarding concentration of oxygen in the injected gaseous desorbing fluid and regarding the distance the gaseous desorbing fluid must travel to move from the injection wellbore to the offset wellbore can be used to predict the concentration of oxygen which can be expected in the fluids recovered from the offset well. In general, if the fluid produced from an offset well contains a higher concentration of oxygen than predicted, then the injected gaseous desorbing fluid travelled through subsurface regions which contain a smaller percentage of carbonaceous material than estimated (i.e., a higher bulk density than estimated).

The ability of the formation to sorb oxygen can also be used to determine the relative percentage of carbonaceous material within the region between the injection wellbore and one offset wellbore as compared to the relative percentage of carbonaceous material within the region between the injection wellbore and another offset wellbore. By correlating the response data from several offset wells, the formation heterogeneity, with respect to the relative percentage of carbonaceous material, can be determined.

Further, the time it takes the gaseous oxygen to reach an offset well is an indicator of whether the gaseous desorbing fluid bypassed the solid carbonaceous subterranean formation. For example, if the injected gaseous desorbing fluid containing oxygen bypassed the majority of the solid carbonaceous subterranean formation and traveled through a non-carbonaceous formation comprised of materials, such as sandstone, the injected gaseous desorbing fluid should reach an offset well relatively early in time; and at that time, the ratio of oxygen to other injected gaseous desorbing fluid components in the fluid recovered from an offset well will be substantially unchanged relative to the ratio of oxygen to other injected gaseous desorbing fluid components contained within the gaseous desorbing fluid injected into the wellbore. This results because the oxygen is not selectively sorbed by the sandstone as it is by coal and other carbonaceous materials. It is important to determine if such pathways exist so that production projects which utilize enhanced methane recovery techniques can be designed to prevent injected gaseous desorbing fluid from entering such non-carbonaceous regions. This will reduce the amount of gaseous desorbing fluid used and will improve the sweep efficiency of the injected gaseous desorbing fluid.

If a sufficient amount of data can be acquired from offset wells to facilitate the determination of the reservoir quality and the enhanced methane recovery characteristics of the formation, a flow-back period may not be required.

In all aspects of the invention, it is preferable that the radius of investigation be between 5 and 100 times longer than the effective wellbore radius. This will ensure that the quantity of carbonaceous material within the radius of investigation is large enough so that the carbonaceous material contained within the effective wellbore radius will not greatly affect the determination of the reservoir quality and the determination of the enhanced methane recovery characteristics of the formation. The effective wellbore radius preferably is determined by measuring the wellbore pressure response over time after the wellbore is shut-in as described below.

After the injection of the gaseous desorbing fluid has ceased, the wellbore is preferably shut-in and the wellbore pressure response is measured. The wellbore pressure response data obtained during shut-in together with data obtained during the injection of the gaseous desorbing fluid, such as: the wellbore pressure prior to shut-in, the rate of injection of gaseous desorbing fluid, and the quantity of gaseous desorbing fluid injected into the formation can be used to calculate the wellbore skin, reservoir pressure, effective wellbore radius, and effective permeability of the formation. If the wellbore is not shut-in, values for wellbore skin, reservoir pressure, effective wellbore radius, and effective permeability can be obtained from literature references, or pressure fall-off or pressure buildup tests which are performed either before the injection of gaseous desorbing fluid or after the flow-back period. The values of wellbore skin, reservoir pressure, effective wellbore radius, and effective permeability are used during the history matching procedure to aid in the determination of the reservoir quality and the enhanced methane recovery characteristics of the formation.

The wellbore preferably is re-opened and fluid is allowed to flow-back through the wellbore from the solid carbonaceous subterranean formation after the injection period or after a shut-in period, if performed. During this "flow-back" period, the fluid production rate and the chemical composition of the produced fluid is monitored. Additionally, the pressure in the wellbore near the formation preferably is monitored.

IMPLEMENTATION

The manner in which the invention is implemented can vary depending on the characteristics of the solid carbonaceous subterranean formation on which it is used. The gaseous desorbing fluid may be injected into only one wellbore which penetrates the solid carbonaceous subterranean formation, or it may be injected separately into more than one wellbore which penetrate the formation. Since solid carbonaceous subterranean formations are typically very heterogeneous, it is often preferable to utilize the method on more than one wellbore to facilitate evaluating the reservoir continuity and reservoir heterogeneity of the formation. It may be especially important to inject gaseous desorbing fluid into more than one wellbore when the method is to be used on solid carbonaceous subterranean formations from which methane has not been recovered in the past. The reservoir properties obtained from each of the wellbores can be correlated so that the horizontal heterogeneity of the formation, any anisotropy of the formation, and the size and continuity of the reservoir can be determined. This information will aid in designing a production project which utilizes the proper location for production and/or injection wells, along with the optimum spacing to use between wells for primary pressure depletion or enhanced methane recovery techniques.

In one aspect, the invention is utilized to determine the horizontal heterogeneity of a solid carbonaceous subterranean formation. For example, referring to FIG. 2, a region of the earth's surface is depicted. Located below the earth's surface is a formation which contains coal. Exploratory wellbores 1–11 are drilled into the earth at the locations shown. The invention is utilized on each wellbore to determine the reservoir properties within the radius of investigation for each wellbore. The reservoir properties for each wellbore are then correlated to determine the horizontal heterogeneity of the formation and the reservoir continuity of the formation. The correlation shows that the solid carbonaceous subterranean formation shows a high degree of anisotropy as described below.

Figure 2:
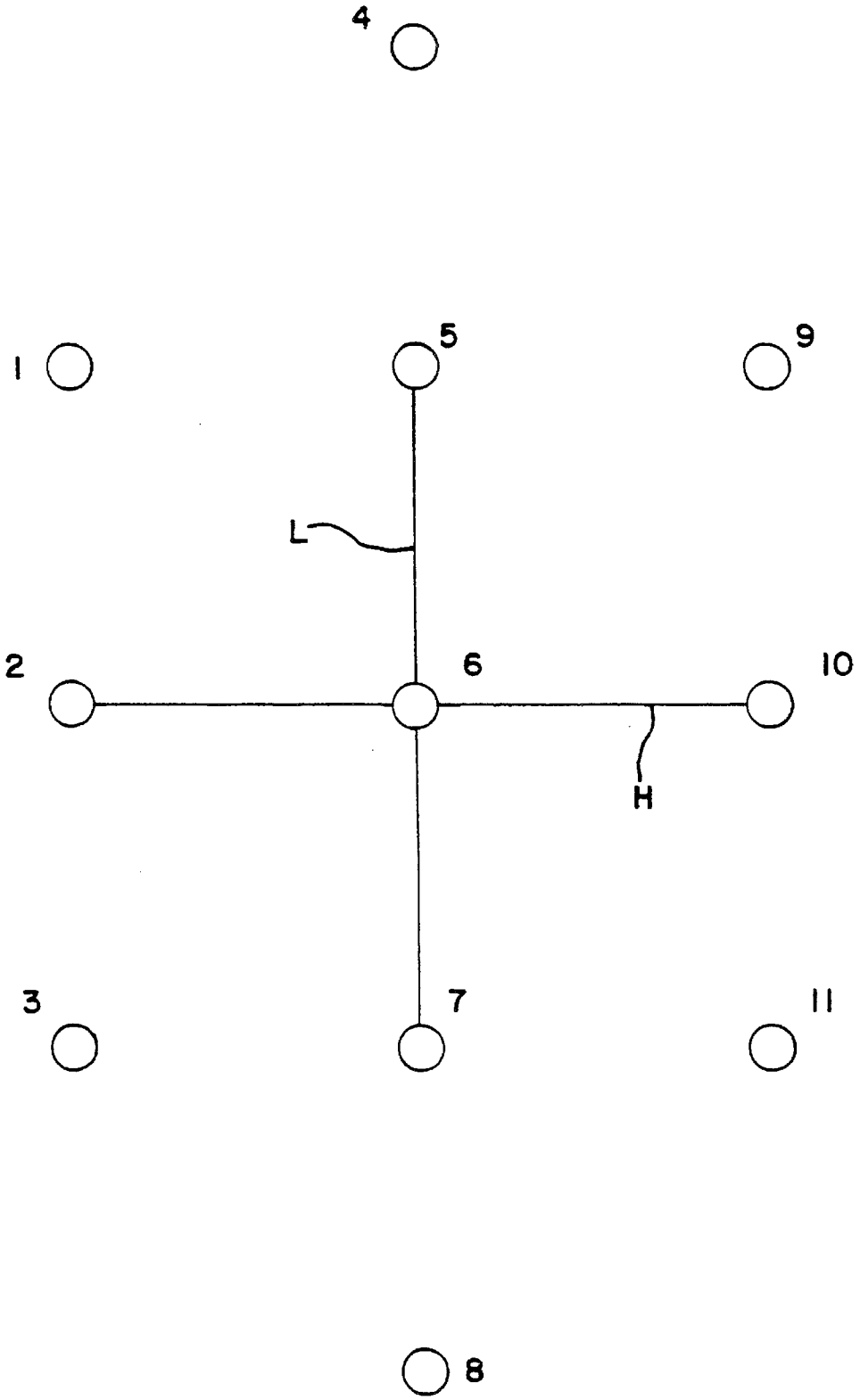
FIG. 2 is a schematic diagram illustrating a field which has eleven wellbores which are drilled into the earth's subsurface. Wells 1 through 3, 5 through 7, and 9 through 11 are in fluid communication with a solid carbonaceous subterranean formation which contains coal. Wellbores 4 and 8 are not in fluid communication with the solid carbonaceous subterranean formation.

Referring to FIG. 2, the highest permeability in the region between and surrounding wellbores 5–7 is oriented parallel to a hypothetical line L drawn through wellbores 5, 6, and 7, and is two to ten times the magnitude of the highest permeability in the region penetrated by wellbores 1, 2, 3, 9, 10, and 11. The highest permeability in the regions penetrated by wellbores 1, 2, 3, 9, 10, and 11 is oriented perpendicular to the line H drawn through wellbores 5, 6, and 7. The invention also shows that wellbores 4 and 8 are not in fluid communication with the coal of the formation.

It is believed that in this type of situation, injection wells should be completed into the formation in the regions penetrated by wellbores 5 and 7, that recovery wells should be completed into the formation in the regions penetrated by wellbores 1, 2, 3, 6, 9, 10, and 11, and that wellbores 4 and 8 should be plugged and abandoned or used as monitor wells to check for leakage from the coal of the formation into the subterranean region penetrated by wellbores 4 and 8.

The injected gaseous desorbing fluid will relatively quickly sweep the region between wellbores 5 and 6 and the region between wellbores 6 and 7. During this time period, methane and any gaseous desorbing fluid will be produced from wellbore 6. Once the methane has been efficiently swept from these regions, wellbore 6 is either shut-in or it is converted to an injection wellbore. As gaseous desorbing fluid is injected into the regions between wellbores 5 and 7, wellbores 5, 7, and 6, if used, will connect up. This will cause gaseous desorbing fluid to efficiently sweep the region between wellbores 5–7 and 1–3 and the region between 5–7 and 9–11. During this time period, methane and any gaseous desorbing fluid will be produced from wellbores 1–3 and 9–11.

In another aspect, the invention is used to determine whether a wellbore is in fluid communication with a sandstone formation which lies either above or below a coal seam. In this aspect of the invention, air or some other gaseous fluid which contains oxygen is injected into the wellbore and then later flowed-back through the wellbore to the surface. The total fluid flow-back rate and the chemical composition of the fluid flowed-back are monitored. As discussed earlier, it has been discovered that the carbonaceous material contained in solid carbonaceous subterranean formations, such as coal, is capable of sorbing large quantities of oxygen. It is believed that the majority of the oxygen is chemically sorbed to the carbonaceous material and that it will not be released from the coal during the flow-back period. The quantity of oxygen which can be chemically sorbed to coal can be determined empirically. This value can be input into a numerical reservoir simulator which can then be used to calculate the concentration of oxygen which can be expected to be flowed-back from the wellbore. If the fluid flowed-back from the wellbore contains a greater concentration of oxygen than expected, it is an indication that the wellbore may be in fluid communication with sandstone or some other type of non-carbonaceous formation which does not readily chemically sorb oxygen. Therefore, by measuring the oxygen concentration in the flowed-back fluid, it can be determined whether the wellbore is in fluid communication with sandstone and/or shales which do not contain significant percentages of carbonaceous material. When determining the concentration of oxygen which can be expected in the flowed-back fluid, it is important to take into account any time in which the wellbore may be shut-in between the injection period and the flow-back period. It is believed that in general, the longer the wellbore is shut-in, the lower the concentration of oxygen in the flowed-back fluid.

For coal seams composed of between 70 and 100 percent by weight carbonaceous material, the ratio of oxygen to other injected gaseous desorbing fluid components recovered during the flow-back period is expected to be less than 1/10 of the magnitude of the ratio of oxygen to other injected gaseous desorbing fluid components in the gaseous desorbing fluids injected during the injection period. For coal seams containing a high percent by weight carbonaceous material and a high maximum sorption capacity for oxygen, the ratio of oxygen to other injected gaseous desorbing fluid components recovered during the flow-back period is expected to be less than 1/50 of the magnitude of the ratio of oxygen to other injected gaseous desorbing fluid components in the gaseous desorbing fluids injected during the injection period. In general, for coal seams, the ratio of oxygen to other injected gaseous desorbing fluid components recovered during the flow-back period is expected to be between 1/10 and 1/50 of the magnitude of the ratio of oxygen to other injected gaseous desorbing fluid components in the gaseous desorbing fluids injected during the injection period.

If a wellbore is to be used as an injection well on a production project which will use enhanced methane recovery techniques, it may be important to isolate the non-carbonaceous formations from the injection wellbore by the use of a wellbore packer or other techniques known to one of ordinary skill in the art.

Determining whether a wellbore is in fluid communication with non-carbonaceous formations such as sandstone can also be important when the wellbore has a relatively high water production rate which does not tend to decrease over time. Wellbores which penetrate coal seams often initially produce water. However, since the cleat system of coal seams typically contain a relatively small amount of pore space, the water production rate generally reduces significantly after a few years of production, typically to about one-half the initial water production rate after one to two years. If it is determined, through use of the invention, that a wellbore is in communication with sandstone, then the water may be coming from the sandstone. In this type of situation, the sandstone can be isolated from the wellbore as described above or a new wellbore can be completed which only penetrates the coal seam and the old wellbore can be plugged and abandoned. Isolating the water flow can be very important because of the cost and the difficulty of handling and disposing of produced water.

In yet another aspect, the invention is utilized on a solid carbonaceous subterranean formation which contains several carbonaceous seams. The carbonaceous seams are vertically interspersed with layers of sandstone or shale. In this type of situation, it can be important to individually determine the reservoir quality and/or the enhanced methane recovery characteristics of each of the major carbonaceous seams individually.

In this aspect of the invention, a wellbore preferably is drilled which penetrates all the major carbonaceous seams. The wellbore is completed with perforations in the wellbore casing adjacent to each of the major carbonaceous seams. Wellbore packers are used so that gaseous desorbing fluid can be injected and flowed-back individually from each major carbonaceous seam. In this aspect, it is preferable to shut-in the wellbore after gaseous desorbing fluid is injected into each major carbonaceous seam and to measure the pressure fall-off which occurs over time.

The reservoir quality and the enhanced methane recovery characteristics are determined for each major seam by history matching a numerical reservoir simulator with the data obtained from the injection, shut-in, and flow-back period. The decision regarding what type of methane recovery scheme to use to recover methane from the formation will depend on the reservoir quality and the enhanced methane recovery characteristics determined for each seam. For example, if a seam has an effective permeability several magnitudes greater than the other seams, but has low adsorbed methane content, it may be preferable to isolate that seam from injected gaseous desorbing fluid and recover methane from that seam by means of pressure depletion techniques. Thereby, methane will be recovered from some seams using enhanced recovery techniques, while methane is recovered from other seams using pressure depletion techniques.

By injecting gaseous desorbing fluid into a single or multiple carbonaceous seams, the magnitude of any vertical segregation of water and gas within a carbonaceous seam or between the carbonaceous seams can be approximated. For a wellbore that was producing water prior to the injection period, the water production rate during the early flow-back period will be very low initially and will increase slowly over time if the gas and water saturations within a single seam, or multiple seams, are uniform. This is believed to be a result of the injected gaseous desorbing fluid relatively evenly sweeping the carbonaceous seams and moving any water within the seams away from the wellbore region. If the gas and water are segregated into distinct vertically spaced zones, the water production rate during the early flow back period will be similar to, and possibly higher than the water production rate that existed prior to the injection of the gaseous desorbing fluid into the seam or seams. This is a result of the gaseous desorbing fluid being preferentially injected into the high gas saturation zones, due to the zones high permeability to gas, while the water saturation zones remain relatively unaffected by the injected gaseous desorbing fluid. Modeling and analysis of the water production data before and after injection of the gaseous desorbing fluid into the formation will facilitate the determination of whether gas and water segregation exists within one carbonaceous seam and/or between carbonaceous seams. This will allow a more accurate reservoir description of the formation to be constructed. As with other aspects of the invention, in this aspect of the invention, a numerical reservoir simulator is used to analyze the data. In this aspect, the numerical reservoir simulator is history matched with the water production data to produce a more accurate reservoir description of the formation.

DETERMINING THE RESERVOIR QUALITY AND THE ENHANCED METHANE RECOVERY CHARACTERISTICS

The preferred procedure to utilize for determining the reservoir quality and the enhanced methane recovery characteristics is to history match, with a numerical simulator, the historical data obtained from the injection, flow back, and/or production periods. During the history match procedure, approximate values for various reservoir properties are input into the "reservoir description" used by the numerical simulator. As the procedure is carried out, reservoir properties, such as permeability or porosity, are adjusted until a "history match" is obtained between the output of the reservoir simulator and the historical data being matched. An updated and improved reservoir description is obtained as a result of the history match procedure. If the enhanced methane recovery characteristics are being determined, the reservoir description is referred to as an "enhanced methane recovery reservoir description."

During the history match procedure, the stress dependent permeability relationship which is exhibited by the formation, as gaseous desorbing fluid is injected into the formation and then flowed-back are preferably taken into account. Also, the numerical reservoir simulator preferably accounts for the characteristic diffusion time of various gases within the formation. It is believed that the incorporation of both these factors into the reservoir description will facilitate a more accurate determination of the reservoir properties of the formation. Further, these factors should be taken into account when the numerical reservoir simulator is used to predict the methane recovery rates which can be achieved by using enhanced methane recovery techniques on a coal seam or some other solid carbonaceous subterranean formation. An example of a commercially available numerical reservoir simulator which takes into account the characteristic diffusion time of various gases within a coal seam is *SIMED II—Multi-component Coalbed Gas Simulator,* which is a coalbed methane reservoir simulator which is available from the Centre for Petroleum Engineering, University of New South Wales, Australian Petroleum Cooperative Research Center. The characteristic diffusion time can be input into the simulator directly or it can be accounted for by inputting a value for diffusivity or diffusion constants into a numerical reservoir simulator. The stress dependent permeability relationship can be accounted for as further discussed below.

EXAMPLE

Figure 3:
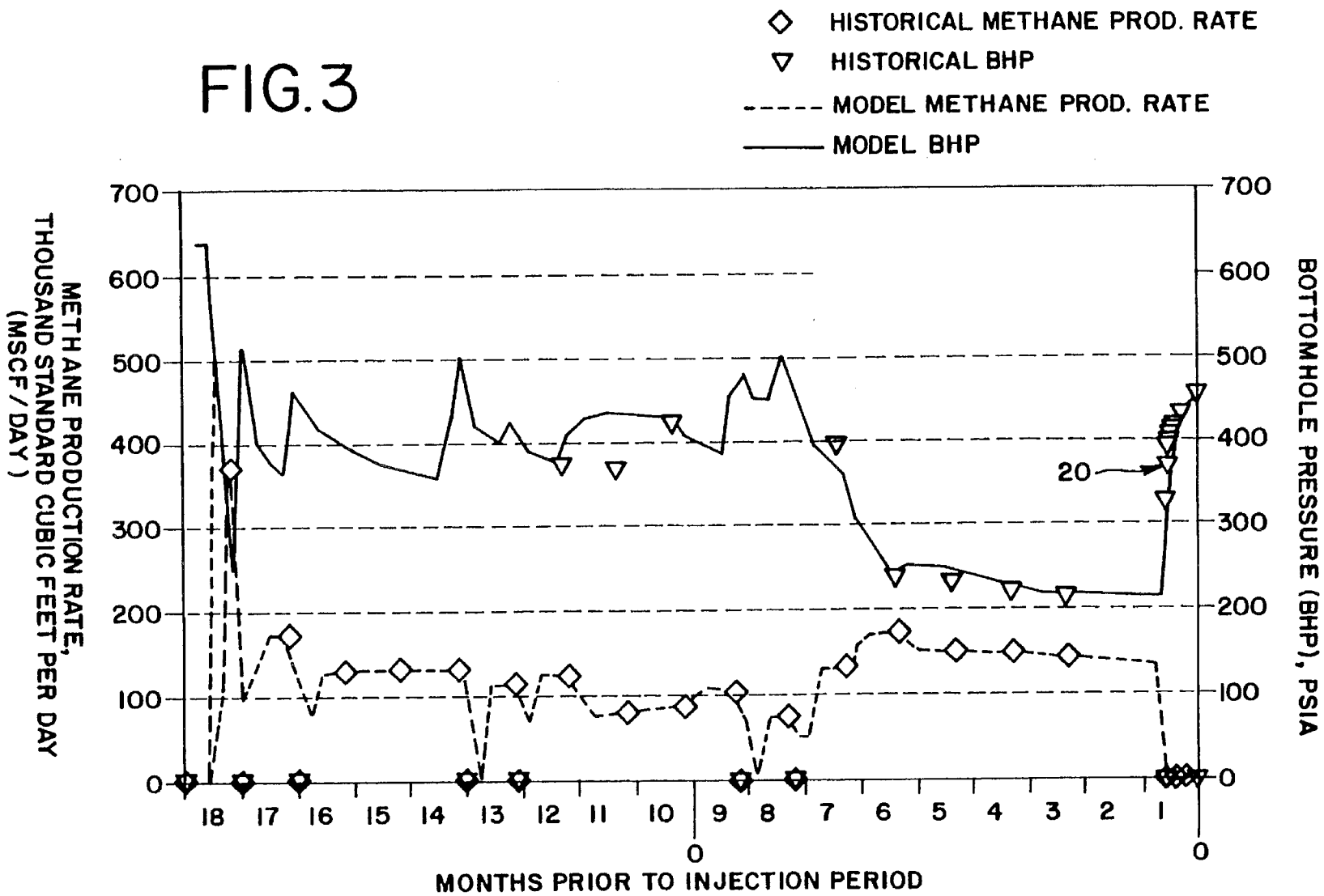
FIG. 3 is a plot of a history match of the pre-injection primary pressure depletion methane recovery period for a solid carbonaceous subterranean formation.

This Example shows how data obtained from a production, an injection, a shut-in, and a flow-back period can be used to determine the enhanced methane recovery characteristics of a formation which contains a least one coal seam. A pilot test of the invention was carded out in a coalbed methane field located in the San Juan Basin of New Mexico. In this test, a single wellbore was used for injecting gaseous desorbing fluid into the fruitland coal formations. The wellbore was drilled to a depth of 2975 feet. The total thickness of the coal, which was investigated by the invention, was approximately 55 feet. The coal investigated is located in two major coal intervals, one located between 2747 and 2844 feet below the surface and the other between 2844 and 2870 feet below the surface. The wellbore is completed with casing which is perforated in the regions adjacent the two major coal intervals. The wellbore was initially completed with a slick water fracture treatment which used 150,000 lbs of 40/40 and 20/40 mesh sand. Cumulative production of methane from the well prior to the injection of gaseous desorbing fluid was 63.9 million standard cubic feet (MMCF) of gas. This initial production period is depicted on FIG. 3. The spacing between the pilot wellbore and the nearest offset wellbore was 3734 feet, which corresponds to a total drainage area of 320 acres for the wellbore being tested.

The wellbore was shut-in for approximately nineteen days prior to commencing to inject gaseous desorbing fluid to allow the pressure in the wellbore near the formation to approach stabilization conditions. The pressure response of the wellbore during this period is shown on FIG. 3, region 20 and FIG. 4, region 21.

The gaseous desorbing fluid used for this Example was air which was found at the well site and contained between 20 and 22 volume percent oxygen and between 78 and 80 volume percent nitrogen. It was assumed that the air will cause the same pressure response as nitrogen and therefore, the entire volume of air injected into the coalbed was modeled as injected nitrogen in the numerical reservoir simulator.

Figure 4:
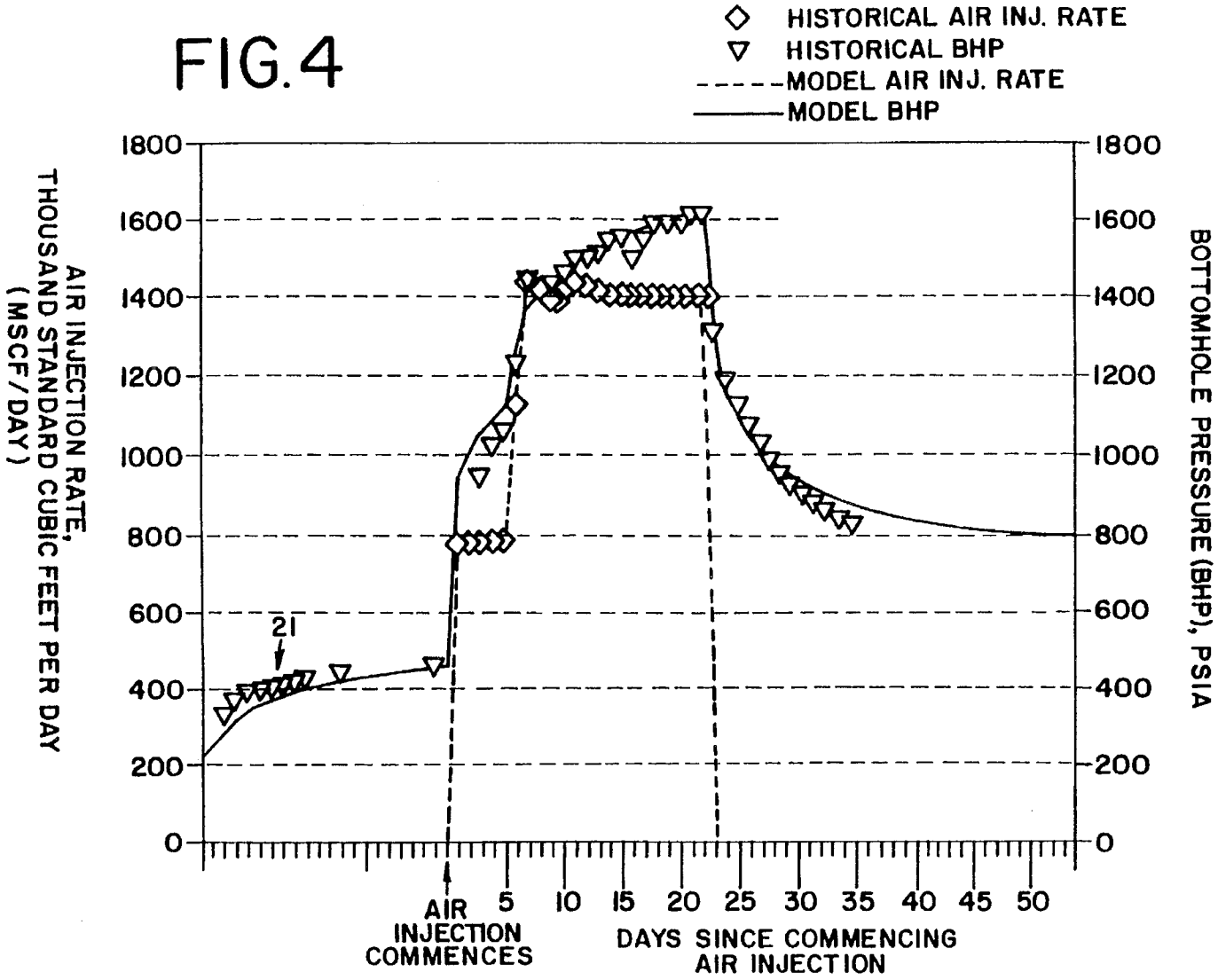
FIG. 4 is a plot of a history match of an air injection period and a subsequent shut-in period for the same wellbore as depicted in FIG. 3.
Figure 5:
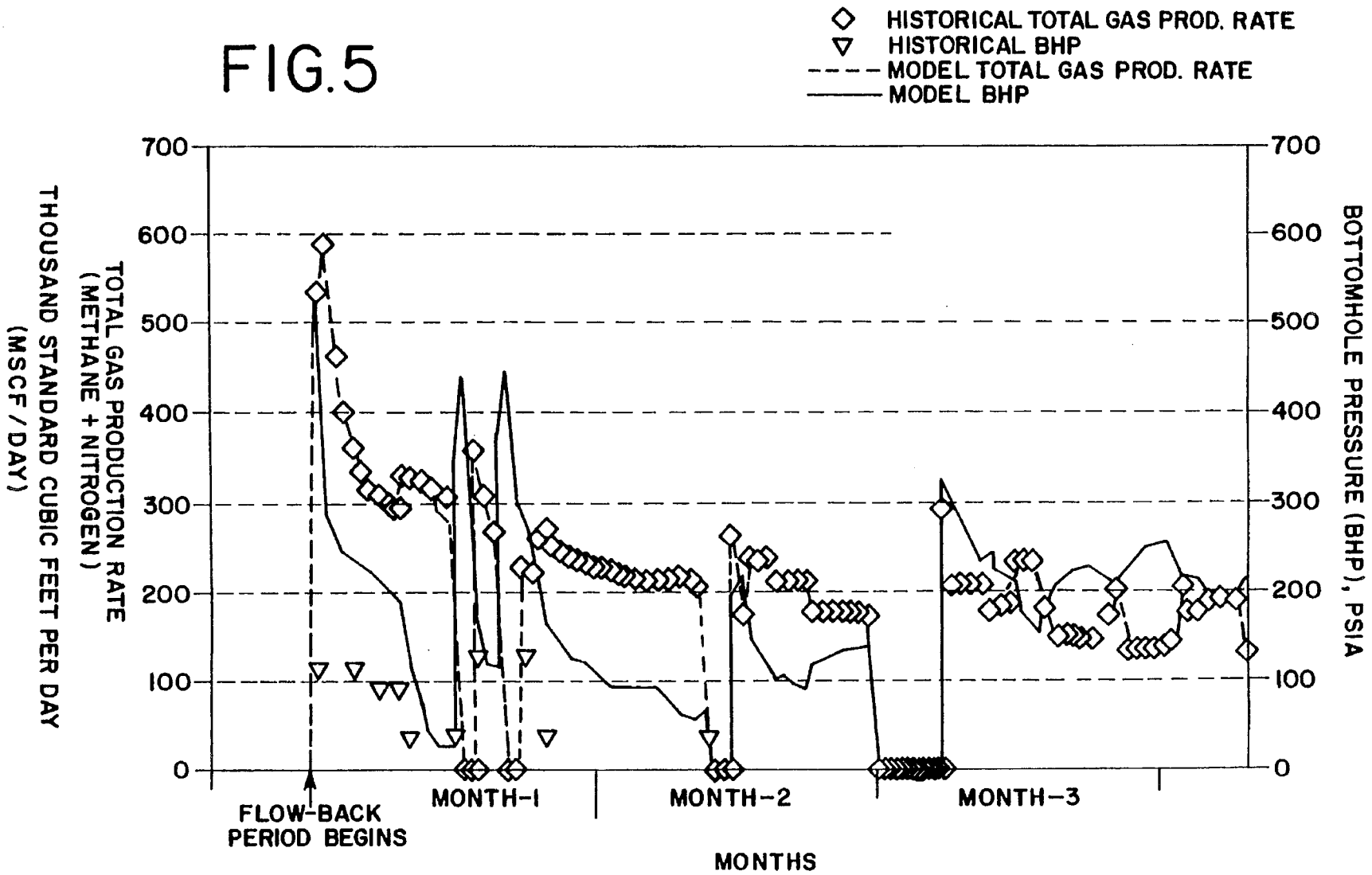
FIG. 5 is a plot of a history match of a flow-back period for the same wellbore as depicted in FIGS. 3 and 4.
Figure 6:
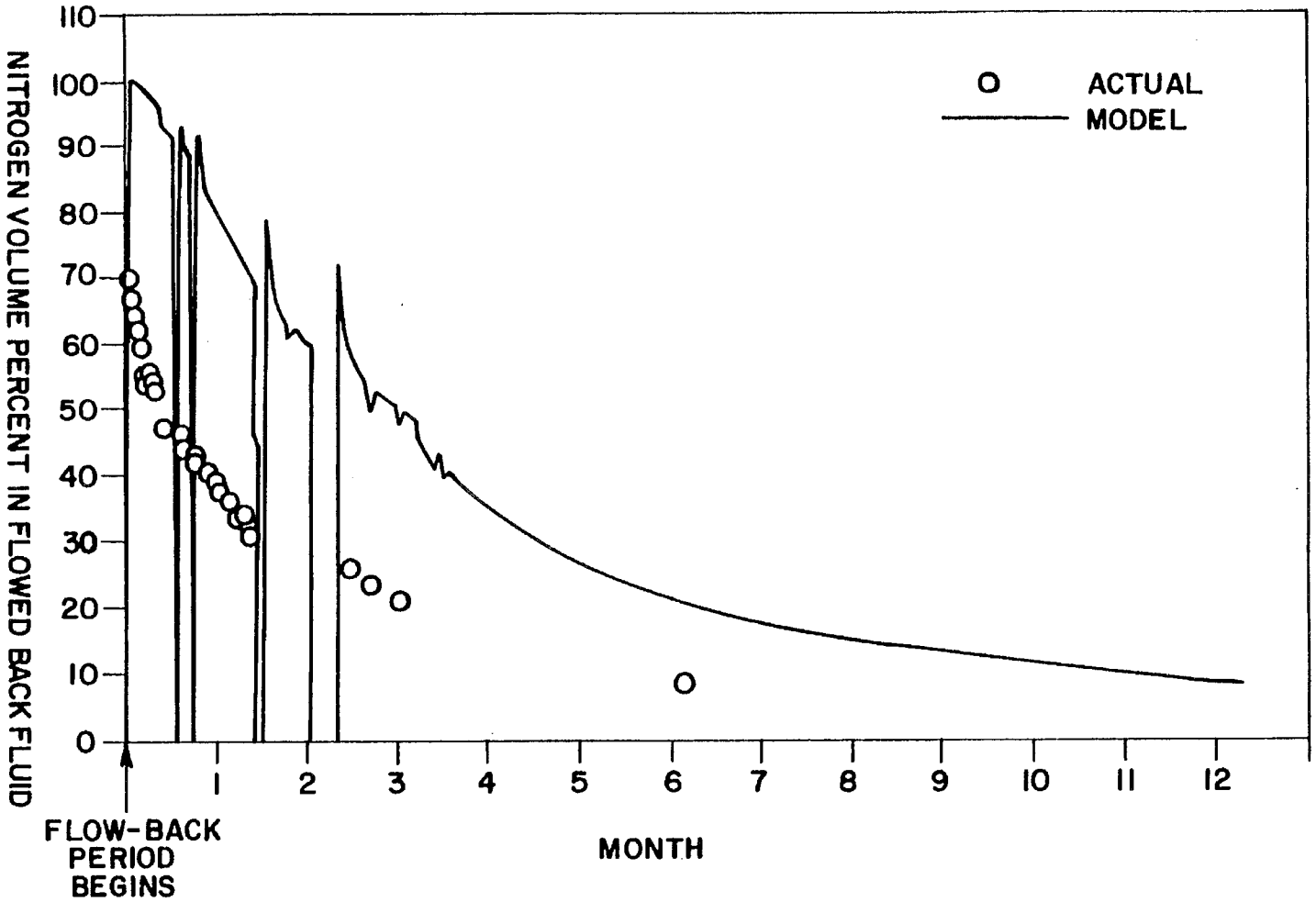
FIG. 6 is a plot of a history match of the nitrogen volume percent in the fluid recovered during the flow-back period.

The gaseous desorbing fluid was injected in steps as depicted on FIG. 4. During the first step, air was injected at a rate of approximately 800,000 standard cubic feet per day at a bottom-hole injection pressure of approximately 800 p.s.i.a. After five days, the air injection-rate was increased to approximately 1,400,000 standard cubic feet per day at a bottom-hole injection pressure of approximately 1,400 to 1,600 p.s.i.a. The air injection was ceased after approximately sixteen days at the higher rate of injection. The wellbore was shut-in after the injection was ceased, and the pressure fall-off response was monitored, as depicted in FIG. 4. After approximately 30 days, the wellbore was reopened and allowed to flow-back against a constant backpressure to the surface. During the flow-back period, the bottom-hole pressure and the chemical composition of the fluid being flowed-back are monitored as depicted in FIGS. 5 and 6. For the pilot, the sum of the volume percent of methane in the flowed-back fluid plus the volume percent of nitrogen in the flowed-back fluid was equal to one hundred percent. For approximately the first 60 days of the flow-back period, the fluid was vented to the atmosphere, thereafter, the well was aligned to send the fluid to the sales pipeline. During the pilot test, approximately 4 acres were probed by the injected air. Therefore, approximately 1% of the volume of the total drainage area available to the pilot wellbore was probed by the air during the procedure.

The pressure fall-off response during the post-injection shut-in period was analyzed to obtain values for the effective permeability (k) of the coal seam surrounding the wellbore, the fracture half length ($x_f$), the wellbore skin factor, and the reservoir pressure at the start of the flow-back period. A value for the permeability of the coal seam could alternatively be determined from laboratory desorption experiments.

The above listed values together with the parameters listed in table 1, are input into a into a numerical reservoir simulator which is history matched with data obtained from the pre-injection production, injection, and flow-back periods.

TABLE 1

| Model Input Parameters | |
|---|---|
| Ø, porosity (%) | 0.2 |
| k, horizontal permeability (md) | 0.35 |
| h, reservoir thickness (ft) | 55 |
| $c_w$, water compressibility ($psi^{-1}$) | $3 \times 10^{-6}$ |
| $\rho_w$ @ 14.7 psia, water density ($lb/ft^3$) | 62.43 |
| $\mu_w$, water viscosity (cp) | 1.0 |
| $r_w$, wellbore radius (ft) | 0.23 |
| s, skin factor | −5.2 |
| $r_{weff}$, effective wellbore radius (ft) | 39.7 |
| $p_i$, initial reservoir pressure (psia) | 650 |
| $\rho_B$, bulk density (gm/cc) | 1.53 |
| $V_{mCH4}$, maximum sorption capacity-methane (scf/ton) | 475 |
| $b_{CH4}$, Langmuir constant - methane ($psi^{-1}$) | 0.0139 |
| $V_{mN2}$, maximum sorption capacity - nitrogen (scf/ton) | 194 |
| $b_{N2}$, Langmuir constant - nitrogen ($psi^{-1}$) | 0.000734 |
| L, layers | 1 |
| $c_f$, rock compressibility ($psi^{-1}$) | $9.61 \times 10^{-4}$ |
| $r_i$, radius of investigation (feet) | 233 |

The values for $V_m$ and b above are from empirical derived methane and nitrogen mineral matter free isotherms obtained for coals which are physically similar to the coals investigated in the pilot test. The value for the initial reservoir pressure ($P_i$), reservoir thickness (h), and bulk density (gm/cc) were obtained from logs made at the time of the original completion of the wellbore. The value for rock compressibility was obtained from desorption experiments conducted on coals which are physically similar to those found at the test site.

The numerical reservoir simulator used in this Example was an extended Langmuir adsorption isotherm compositional type simulator. The extended Langmuir adsorption isotherm is described by Equation 2 below:

$$V_i = \frac{(V_M)_i b_i P_i}{1 + \sum_j b_j P_j} \tag{2}$$

The simulator is capable of accepting inputs relating to rock properties, fluid properties, relative permeability relationship, and stress dependent permeability relationship. For this example, the reservoir was modeled as a single well, single layer, radial model with logarithmically spaced gridpoints. In the Example, one layer was used to simplify the history match procedure. A description of an extended Langmuir adsorption isotherm model and how to use it is disclosed in L. E. Arri, et. al, "Modeling Coalbed Methane Production with Binary Gas Sorption," SPE 24363, pages 459–472, (1992), published by the Society of Petroleum Engineers; which is hereby incorporated by reference.

During the history match procedure, the effective permeability relationship was adjusted until a match was achieved between the predicted and historical data. As discussed earlier, the effective permeability relationship is effected by the stress dependent permeability relationship which the coal exhibits and the relative permeability relationship with exists within the coal. Both these relationships can be accounted for by data tables within the simulator.

In the Example, the water production rate at the time of the test was small and there was little historical data regarding the past water production. Therefore, the relative permeability relationship which exists within the coal was not taken into account. The effective permeability relationship was adjusted to take into account how the stress dependent permeability relationship exhibited by the coal is effected by changes in pore pressure.

FIG. 1 shows both the theoretical and the fitted stress dependent permeability relationships for the coal. Stress dependent permeability is dependent on the net confining stress the coal is under, which is equal to the burial stress minus the pore pressure in this Example. FIG. 1 was developed for a coal seam which is about 2,800 feet below the earth's surface. Therefore, since the burial stress remains constant, FIG. 1 shows the changes in the effective permeability relationship which occur as the pore pressure changes. FIG. 1 plots the permeability ratio ($K_f/K_i$) versus pore pressure. Where $K_f$ is the effective permeability at a given pore pressure and $K_i$ is the effective permeability which existed at the initial reservoir pressure. The theoretical stress dependent permeability relationship which is depicted by curve 25 was determined empirically by measuring the permeability decrease, within a core sample, which occurs as the net confining stress on the core sample increases.

The theoretical stress dependent permeability relationship was input in the simulator as a data table within the rock properties section of the simulator. The stress dependent permeability relationship was then adjusted until a history match was obtained with the data collected during the pre-injection production and air injection periods. The history matched value for the stress dependent permeability relationship is depicted by fitted curve 27.

The discrepancy between theoretical curve 25 and fitted curve 27 during the pre-injection production and air injection period is believed to be a result of the simulator not accounting for the relative permeability relationship exhibited over time by the formation. As is shown by fitted curve 27, the permeability ratio increases exponentially as pore pressure is increased, until, eventually a pressure is reached where the curve flattens out.

Fitted curve 29 depicts the history matched stress dependent permeability relationship which is exhibited by the formation during the flow-back period. As can be seen from fitted curve 29, the stress dependent permeability relationship exhibits a hysteresis effect whereby the permeability ratio is greater at the end of the flow-back period than prior to the air injection period.

FIG. 6 shows the volume percent of nitrogen contained in the fluid produced during the flow-back period. It is believed that the discrepancy between the actual nitrogen composition and the predicted nitrogen composition occurs because the numerical reservoir simulator used in this Example was not capable of accounting for characteristic diffusion time. The simulator used assumes that the characteristic diffusion time is zero. Or, in other words, that the nitrogen and methane adsorb and desorb instantaneously. Further, it is believed that the discrepancy shown in FIG. 5 between the predicted bottomhole pressure and the historical bottomhole pressure during the early flow-back period also results because of the simulator's inability to account for characteristic diffusion time. This results in the simulator predicting more pressure support from nitrogen desorbing off the coal than actually occurs during the early portion of the flow-back period. As discussed below, the failure to take into account the characteristic diffusion times of methane and gaseous desorbing fluid molecules will also make the predictions of future enhanced methane recovery rates less accurate.

As discussed earlier, the reservoir description contained within the numerical reservoir simulator is updated as the history match procedure is taking place. The numerical reservoir simulator, with the updated reservoir description, can be utilized to predict the recovery that can be expected from a formation using primary pressure depletion or enhanced methane recovery techniques.

Figure 7:
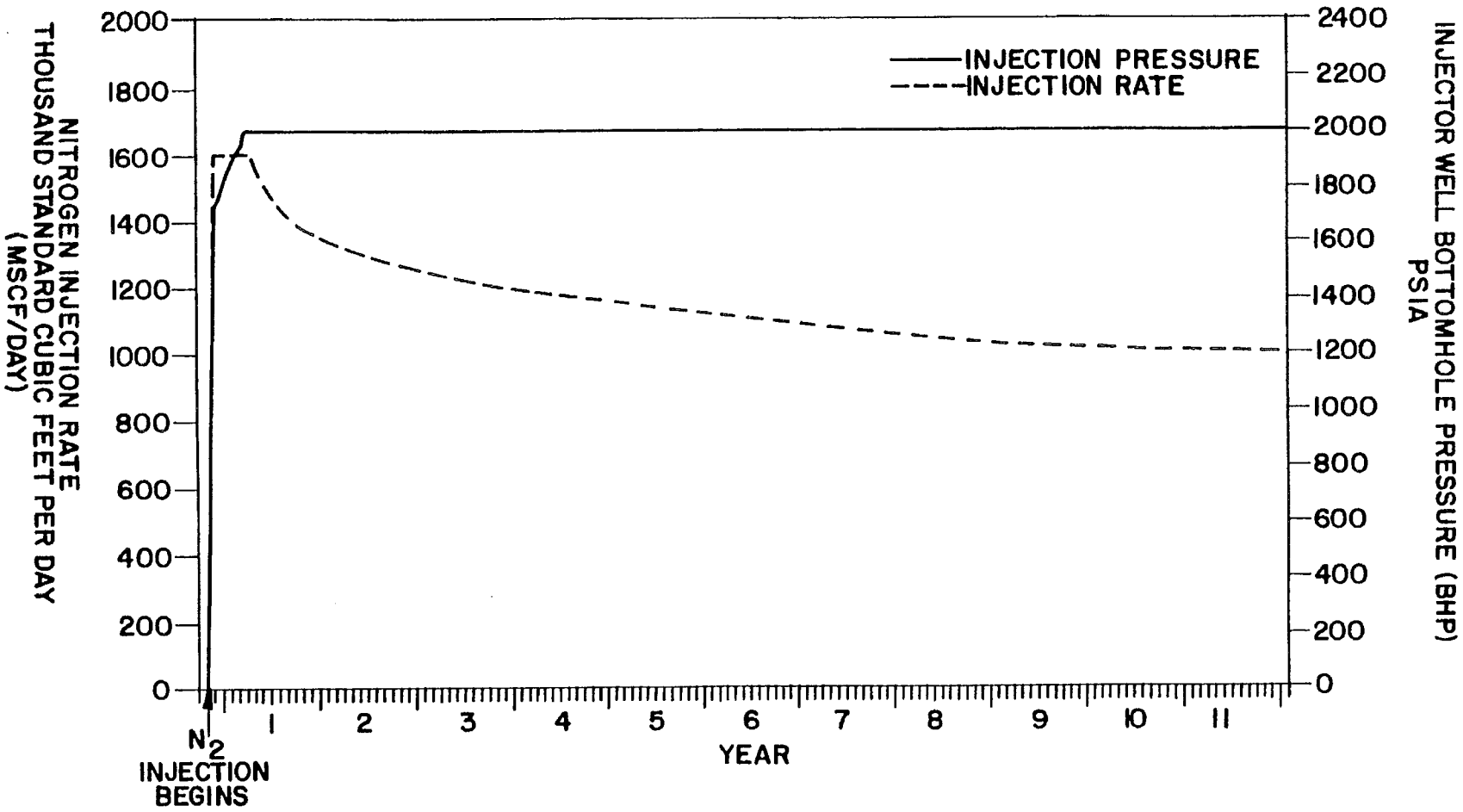
FIG. 7 is a graph of the predicted nitrogen injection rate and associated bottomhole injection pressure for an injection well which is utilized in a nine-spot enhanced methane recovery scheme as depicted in FIG. 10.
Figure 8:
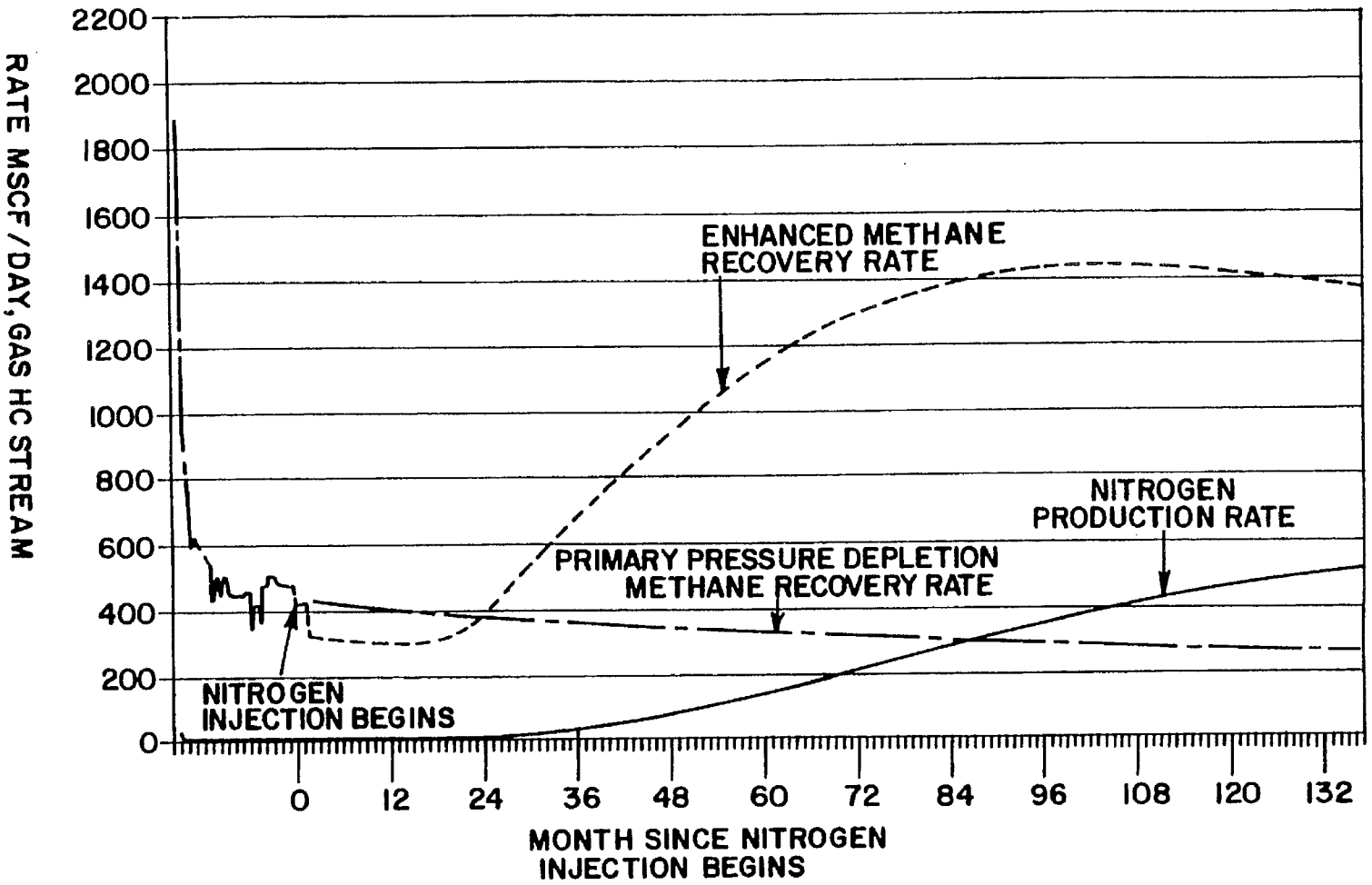
FIG. 8 is a graph of the predicted enhanced methane recovery rate, the predicted primary pressure depletion methane recovery rate, and the predicted nitrogen production rate from the same nine-spot coalbed methane recovery scheme as depicted in FIG. 10.
Figure 9:
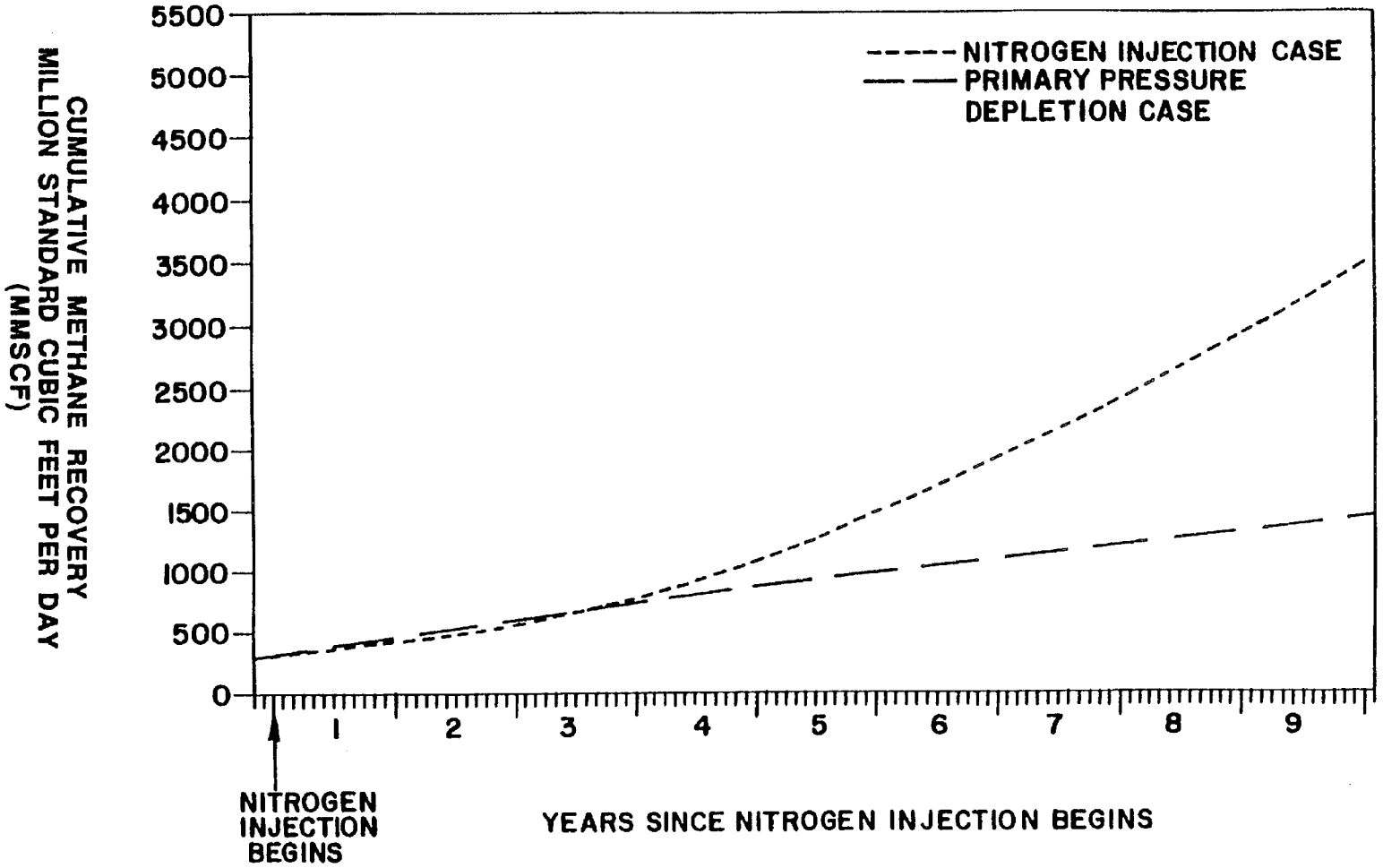
FIG. 9 is a graph of the cumulative methane predicted to be recovered from the nine-spot depicted in FIG. 10. Both the methane predicted to be recovered using primary pressure depletion techniques and the methane predicted to be recovered using enhanced methane recovery techniques are shown.
Figure 10:
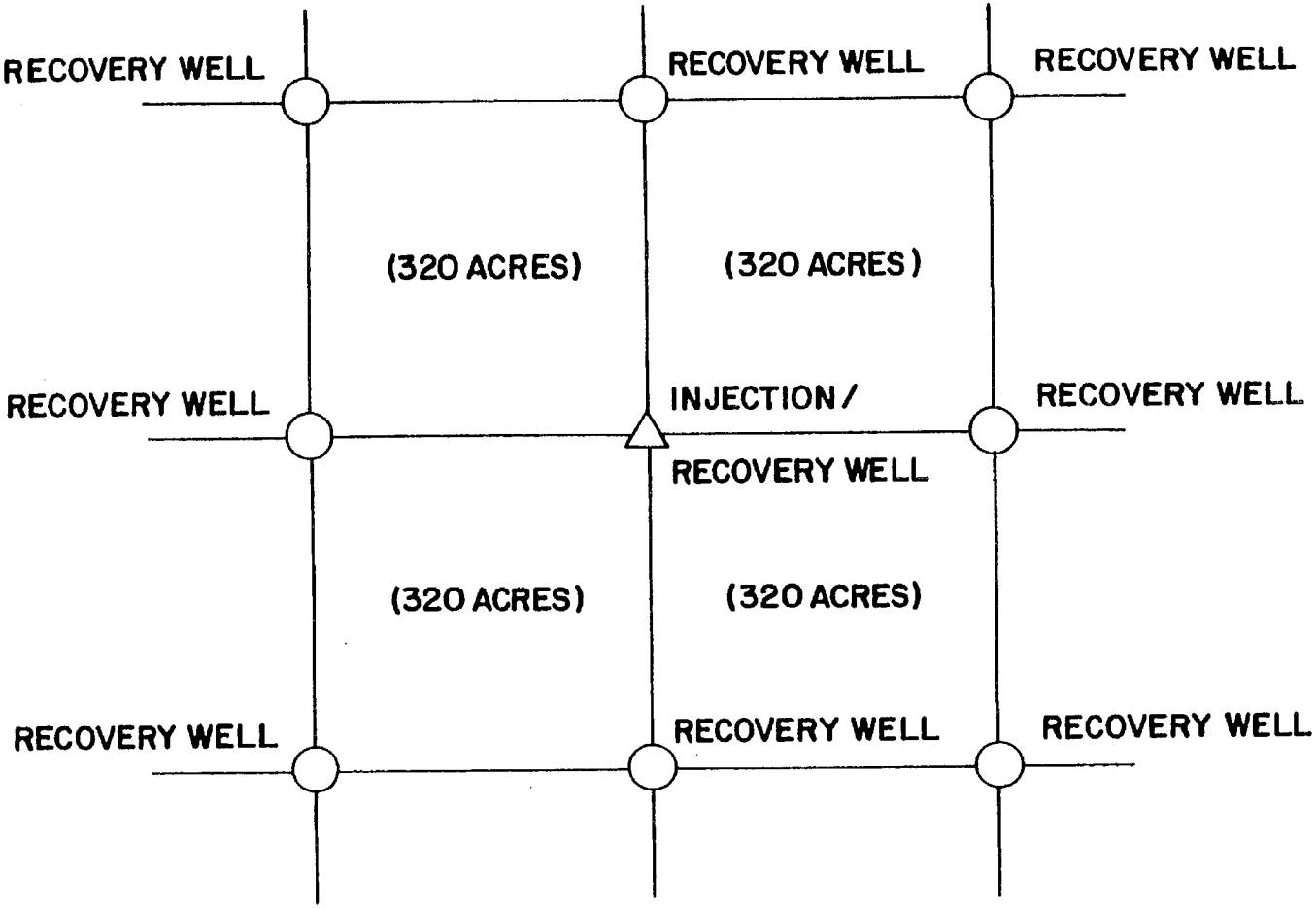
FIG. 10 is a schematic view of a nine-spot well arrangement which is used to recover methane from a coalbed.

FIGS. 7 through 9 show the methane recoveries and the nitrogen production rates that are predicted for a production project which recovers methane from the formation analyzed by the pilot test. The production project uses nine (9) wells, which are spread out over a 1280 acre area and are spaced as shown in FIG. 10. For the enhanced methane recovery scheme, the center well is an injection well and the surrounding eight wells are recovery wells. For the primary depletion recovery scheme, all nine wells are recovery wells.

For the enhanced recovery scheme it was assumed that nitrogen will be injected into the formation at a rate of 1,600,000 standard cubic feet per day with a bottomhole pressure in the injection well of 2000 p.s.i.a. The injection well was assumed to have a wellbore skin factor of −4.75. The bottomhole pressures in the recovery wells used by the model are 300 p.s.i.a. The recovery wells are assumed to have a skin factor of −4.4.

As can be seen from FIG. 8, the predicted enhanced methane recovery rate is lower than the predicted primary depletion recovery rate for the first few years of production. The lower recovery is due to the fact that the center injector is not producing methane in the enhanced recovery scheme and therefore, initially the enhanced methane recovery rate from the project is expected to be lower than the primary depletion methane recovery rate.

It is believed that the actual maximum enhanced methane recovery rate will be lower than predicted by the simulator and that the maximum rate will occur sooner in time than shown in FIG. 8. This is due to the numerical reservoir simulator's, used in this Example, inability to take into account the characteristic diffusion times for methane and nitrogen. Also, it is believed the nitrogen will actually breakthrough to the recovery wells sooner than predicted by the simulator. This is also believed to be a result of the simulator's inability to take into account characteristic diffusion times.

The availability of an accurate reservoir description facilitates the assessment of the technical viability of recovering methane from a solid carbonaceous subterranean formation. Using a numerical reservoir simulator, the methane recovery rate, the volume percent of gaseous desorbing fluid produced from a production well, the water production rate, and the total volume of gas and water that can be expected to be produced from a formation can be reliably forecast. This information relating to future well and field performance will allow a detailed economic analysis to be performed to ascertain the commercial feasibility of recovering methane from a particular proposed production project using either primary pressure depletion or enhanced methane recovery techniques.

As can be seen from this Example and the foregoing description, the invention provides a novel method for using data obtained from an injection/flow-back test in conjunction with reservoir simulation techniques to quickly and efficiently determine the reservoir quality and the enhanced methane recovery characteristics of a solid carbonaceous subterranean formation. It also provides a method for quickly and inexpensively developing a reservoir description for the formation which can be used to predict the commercial feasibility of recovering methane from such a formation.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made and materials may be substituted for those described in the application.

Thus, it will be appreciated that various modifications, alternatives, variations, etc., may be made without departing from the spirit and scope of the invention as defined in the appended claims. It is, of course, intended that all such modifications are covered by the appended claims.

I claim:

1. A method for determining the enhanced methane recovery characteristics of a solid carbonaceous subterranean formation, the method comprising:

a) injecting a gaseous desorbing fluid into the formation through a wellbore while obtaining injection rate data;

b) flowing-back the wellbore to produce a fluid comprising injected desorbing gaseous fluid and methane;

c) obtaining production rate data and chemical composition data for the fluid produced during step b); and d) determining at least one of the following enhanced methane recovery characteristics for the formation surrounding the wellbore using the data obtained in steps a) and c), wherein the enhanced methane recovery characteristic is selected from the group consisting of: effective permeability relationship, characteristic diffusion time for nitrogen, characteristic diffusion time for methane, characteristic diffusion time for the injected gaseous desorbing fluid, stress dependent permeability relationship, relative permeability relationship, reservoir flow capacity, whether the first wellbore is in fluid communication with non-carbonaceous subterranean formations, and combinations thereof.

2. The method of claim 1, wherein step d) comprises history matching a numerical reservoir simulator with the data obtained in steps a) and c).

3. The method of claim 2, wherein the solid carbonaceous subterranean formation comprises a coal seam and the history matching step comprises:

da) obtaining a value for effective permeability, wellbore skin, and reservoir pressure for the coal seam;

db) inputting the values obtained in step da) into the numerical reservoir simulator; and dc) adjusting a reservoir property contained within the simulator to history match the simulator with the data obtained in steps a) and c).

4. The method of claim 3, further comprising e) obtaining pressure data, from the region of the wellbore near the coal seam, during step b).

5. The method of claim 4, wherein the reservoir property adjusted comprises the characteristic diffusion time for the injected gaseous desorbing fluid and wherein the numerical reservoir simulator is history matched with the pressure data obtained in step e).

6. The method of claim 3, wherein the reservoir property adjusted comprises the characteristic diffusion time for the injected gaseous desorbing fluid and the numerical reservoir simulator is matched with the fluid chemical composition data obtained in step c).

7. The method of claim 3, wherein the reservoir property adjusted comprises the effective permeability relationship and the numerical reservoir simulator is matched with the injection rate data obtained in step a).

8. The method of claim 1, wherein the injected gaseous desorbing fluid comprises air.

9. The method of claim 3, wherein step da) comprises:

daa) shutting in the wellbore;

dab) measuring a rate of change in the pressure in the wellbore near the coal seam during step daa); and dac) using the rate of change in the pressure from step dab) to determine a value for effective permeability, wellbore skin, and reservoir pressure of the coal seam surrounding the wellbore.

10. The method of claim 9, wherein steps daa) and dab) are performed prior to step a).

11. The method of claim 9, wherein steps daa) and dab) are performed subsequent to step a) and prior to step b).

12. The method of claim 9, wherein the rate of change in the pressure measured during step dab) is positive.

13. A method for determining the enhanced methane recovery characteristics of a coalbed, the method comprising:

a) injecting a gaseous desorbing fluid into the coalbed through a wellbore which penetrates the coalbed while obtaining injection rate data;

b) flowing-back the wellbore to produce a fluid comprising injected desorbing gaseous fluid and methane;

c) obtaining production rate data and chemical composition data for the fluid produced during step b);

d) obtaining pressure data, from a region of the wellbore which penetrates the coalbed, during step b);

e) history matching a numerical reservoir simulator with the data obtained in steps a), c), and d) to determine at least one of the following enhanced methane recovery characteristics for the coalbed, wherein the enhanced methane recovery characteristics are selected from the group consisting of:

effective permeability relationship, characteristic diffusion time for nitrogen, characteristic diffusion time for methane, characteristic diffusion time for the injected gaseous desorbing fluid, stress dependent permeability relationship, relative permeability relationship, reservoir flow capacity, and combinations thereof; and f) developing an enhanced methane recovery reservoir description using the enhanced methane recovery characteristics determined in step e).

14. The method of claim 13, wherein the gaseous desorbing fluid injected in step a) comprises air containing between about 20 and 22 volume percent oxygen and between about 78 and 80 volume percent nitrogen.

15. The method claim 14, further comprising:

g) measuring a ratio of oxygen to other injected gaseous desorbing fluid components contained in the gaseous desorbing fluid injected in step a);

h ) measuring a ratio of oxygen to other injected gaseous desorbing fluid components contained in the fluids flowed-back in step b); and i) determining if the wellbore is in fluid communication with non-carbonaceous subterranean formations by comparing the ratios measured in steps g) and h).

16. The method of claim 15, wherein the ratio measured in step h) is less than about 1/10 the ratio measured in step g), thereby indicating that the wellbore is not in fluid communication with a non-carbonaceous subterranean formation.

17. The method of claim 15, wherein the ratio measured in step h) is less than about 1/50 the ratio measured in step g), thereby indicating that the wellbore is not in fluid communication with a non-carbonaceous subterranean formation.

18. The method of claim 13, wherein the fluid is injected into the formation in at least two steps, with each subsequent utilizing a higher injection pressure.

19. The method of claim 13, further comprising:

g) predicting an enhanced methane recovery rate for the coalbed by using the enhanced methane recovery reservoir description.

20. The method of claim 13, further comprising:

g) designing an enhanced methane recovery technique for the formation using the enhanced methane recovery reservoir description developed in step f); and h) recovering methane from the formation using the enhanced methane recovery technique.

21. The method of claim 20, wherein designing an enhanced methane recovery technique comprises:

ga) determining a gaseous desorbing fluid injection rate and a pressure at which to inject the gaseous desorbing fluid into the coalbed to recovery methane from the formation.

22. The method of claim 21, wherein designing an enhanced methane recovery technique further comprises;

gb) determining a chemical composition of the gaseous desorbing fluid to be utilized; and gc) determining a well spacing and well placement to be utilized to most effectively recovery methane from the coalbed.

23. The method of claim 21, wherein the coalbed comprises more than one coal seam which are at least partially separated by substantially non-carbonaceous formations, and designing an enhanced methane recovery technique further comprises:

gb) determining which coal seam to inject gaseous desorbing fluid into by using the enhanced methane recovery reservoir description developed in step f).

24. A method for determining the reservoir quality of a coalbed, the method comprising:

a) injecting air into the coalbed through a wellbore while obtaining injection rate data and chemical composition data for the air;

b) flowing-back the wellbore to produce a gaseous fluid;

c) obtaining production rate data and chemical composition data for the gaseous fluid produced during step b); and d) determining whether the wellbore is in fluid communication with non-carbonaceous subterranean formations using the data obtained in step a) and c).

25. The method of claim 24, further comprising:

e) measuring a water production rate from the wellbore prior to step a);

f) measuring a water production rate from the wellbore during step b); and g) determining whether gas and water are segregated into vertically spaced zones within the coalbed by comparing the water production rate measured in step e) with the water production rate measured in step f).

26. The method of claim 24, further comprising:

e) determining at least one of the following reservoir properties for coalbed, wherein the reservoir property is selected from the group consisting of:

reservoir pressure, bulk density of the coalbed, maximum sorption capacity of the coalbed for methane, maximum sorption capacity of the coalbed for nitrogen, maximum sorption capacity of the coalbed for oxygen, reservoir continuity, reservoir heterogeneity, reservoir anisotropy, formation parting pressure, adsorbed methane content of the coalbed and combinations thereof.

27. The method of claim 26, wherein step e) comprises history matching a numerical reservoir simulator with the data obtained in steps a) and c).

28. The method of claim 27, wherein a sufficient volume of air is injected into the coalbed to cause a radius of investigation to be between about 5 and 100 times larger than an effective wellbore radius for the wellbore.

29. The method of claim 28, wherein a sufficient volume of air is injected to cause the radius of investigation to be at least 0.5% of a spacing between the wellbore and a nearest offset wellbore.

30. The method of claim 28, wherein a sufficient volume of air is injected to cause the radius of investigation to be at least 1% of a spacing between the wellbore and a nearest offset wellbore.

31. The method of claim 28, wherein a sufficient volume of air is injected to cause the radius of investigation to be between about 1 and 10% of a spacing between the wellbore and a nearest offset wellbore.

32. The method of claim 26, further comprising:

f) obtaining production rate data and chemical composition data of a fluid produced from a nearby offset wellbore which penetrates the coalbed; and wherein step e) comprises history matching a numerical reservoir simulator with the data obtained in steps a), c), and f).

33. The method claim 32, further comprising:

g) injecting a tracer gas into the coalbed through the wellbore;

h ) measuring the time it takes for the tracer gas to be produced from the nearby offset wellbore; and i) using the time measured in step h) to determine a characteristic residence flow time for a region of the coalbed between the wellbore and the nearby offset wellbore.

34. The method of claim 33, further comprising:

j) determining the characteristic diffusion time using the characteristic residence flow time from step i) and the chemical composition data from step f).

* * * * *

UNITED STATES PATENT AND TRADEMARK OFFICE
CERTIFICATE OF CORRECTION

PATENT NO.: 5,501,273

DATED: March 26, 1996

INVENTOR(S): Rajen Puri

It is certified that error appears in the above-identified patent and that said Letters Patent is hereby corrected as shown below:

| Col. | Line | |
|---|---|---|
| 4 | 63-64 | "a percentage of the formation contacted;" should read --a percentage of the formation contacted.-- |
| 8 | 28 | "(Richardson, Tex., 19901)," should read --(Richardson, Tex., 1990),-- |
| 11 | 64-65 | "them is not an offset wellbore present" should read --there is not an offset wellbore present-- |

UNITED STATES PATENT AND TRADEMARK OFFICE
CERTIFICATE OF CORRECTION

PATENT NO.: 5,501,273

DATED: March 26, 1996

INVENTOR(S): Rajen Puri

It is certified that error appears in the above-identified patent and that said Letters Patent is hereby corrected as shown below:

| Col. | Line | |
|---|---|---|
| 18 | 38 | "the invention was carded out in a coalbed methane field" should read --the invention was carried out in a coalbed methane field-- |

Signed and Sealed this

Twenty-second Day of October, 1996

Bruce Lehman

*Attest:*

BRUCE LEHMAN

*Attesting Officer*

*Commissioner of Patents and Trademarks*